US006053135A

United States Patent [19]

Ochiai et al.

[11] Patent Number: 6,053,135

[45] Date of Patent: Apr. 25, 2000

[54] VARIABLE VALVE TIMING MECHANISM

[75] Inventors: Katsumi Ochiai; Noriyuki Kurihara, both of Iwata, Japan

[73] Assignee: Yamaha Hatsudoki Kabushiki Kaisha, Iwata, Japan

[21] Appl. No.: 09/167,347

[22] Filed: Oct. 7, 1998

Related U.S. Application Data

[63] Continuation-in-part of application No. 08/946,047, Oct. 7, 1997, Pat. No. 5,924,396.

[30] Foreign Application Priority Data

Oct. 7, 1997 [JP] Japan ..... 9-274161

[51] Int. Cl.[7] ..... F01L 13/00

[52] U.S. Cl. ..... 123/90.16; 123/90.45

[58] Field of Search ..... 123/90.15, 90.16, 123/90.17, 90.22, 90.39, 90.4, 90.41, 90.45

[56] References Cited

U.S. PATENT DOCUMENTS

| | | | |
|---|---|---|---|
| 5,148,783 | 9/1992 | Shinkai et al. | 123/90.16 |
| 5,386,806 | 2/1995 | Allen et al. | 123/90.16 |
| 5,474,037 | 12/1995 | Paul | 123/90.16 |
| 5,655,488 | 8/1997 | Hampton et al. | 123/90.16 |

FOREIGN PATENT DOCUMENTS

| | | |
|---|---|---|
| 0 452 671 | 10/1991 | European Pat. Off. . |
| 0 583 584 | 2/1994 | European Pat. Off. . |
| 0 834 647 | 4/1998 | European Pat. Off. . |
| 2535390 | 5/1984 | France . |
| 36 13 945 | 10/1986 | Germany . |
| 3613945 | 10/1986 | Germany . |
| 3814835 | 12/1988 | Germany . |
| 19642059 | 4/1997 | Germany . |
| 08074533 | 3/1996 | Japan . |
| 2254109 | 9/1992 | United Kingdom . |

OTHER PUBLICATIONS

Patent Abstracts of Japan, vol. 015, No. 279 (M–1136), Apr. 1991 & JP 03 096605 A.

Patent Abstracts of Japan, vol. 010, No. 385 (M–548), Dec. 24, 1986 & JP 61 175206 A.

*Primary Examiner*—Weilun Lo

*Attorney, Agent, or Firm*—Knobbe, Martens, Olson & Bear LLP

[57] ABSTRACT

A number of embodiments of variable valve actuating systems wherein the valve is operated selectively by either first or second rocker arms both of which are supported for pivotal movement on the same rocker arm shaft but which are operated by different cams and have different lifts. Only one of the rocker arms directly operates the valve. The lift is changed by selectively coupling the rocker arms for simultaneous operation. A number of variations in locations and valve actuation are disclosed as well as a variable induction system that cooperates with the variable valve actuation to improve the engine performance over a wider range of speeds and loads. The coupling between the rocker arms includes a replaceable adjusting shim.

24 Claims, 21 Drawing Sheets

VARIABLE VALVE TIMING MECHANISM

CROSS REFERENCE TO RELATED APPLICATION

This application is a Continuation in Part of our application entitled "Engine Valve Actuating System", Ser. No. 08/946047, filed Oct. 7, 1997 now U.S. Pat. No. 5,924,396, and assigned to the assignee hereof.

BACKGROUND OF THE INVENTION

This invention relates to an engine valve actuating system and more particularly to an improved arrangement for achieving variable valve actuation (timing and/or lift) in the operation of an engine valve. In addition the invention relates to an improved lash adjustment arrangement useable in engine valve actuation.

As is well-known, many factors in an internal combustion engine represent a design compromise. Generally, the compromise is between achieving good low-speed performance and economy and high output and high power. There has been proposed a wide variety of devices, however, so as to permit the engine characteristics to be adjusted during its running, so as to obtain improved performance across the entire speed and load range. One of these features is variable valve actuation which includes both changing the valve timing and/or the valve lift. Obviously, these present substantial challenges to the engineer considering that the adjustment must be made when the engine is running.

A wide variety of mechanisms have been proposed for achieving either or both of the variable valve timing and variable valve lift. For the most part, however, they are fairly complex and add significantly to the complexity of the valve train.

It was, therefore, a principal object of our earlier invention to provide an improved variable valve actuating mechanism that was relatively simple in construction and which lent itself to incorporation in multi-valve engines.

This was achieved by providing a valve operating mechanism comprised of a single cam shaft having a pair of adjacent cams. A pair of adjacent, pivotally supported rocker arms, each cooperated with a respective one of the cams. A first of the rocker arms had an operating portion for direct cooperation with the valve stem for operating the valve. Means provided a selective coupling of the second rocker arm to the first rocker arm for effecting actuation of the valve through the first rocker arm. Thus, by providing different characteristics of the cam and rocker arms, varying lift and/or duration was achieved.

In order to provide the coupling between the first and second rocker arms and to adjust for wear and other conditions, a mechanism was provided for permitting adjustment in the relationship between the two rocker arms. This utilized a conventional type of adjusting screw.

The use of the adjusting screw somewhat complicates the overall valve mechanism and further requires sufficient clearances so that the screw can be adjusted and so that the relative movement between the rocker arms can be accommodated.

It is, therefore, a principal object of this invention to provide an improved construction of this type wherein the interrelationship between the two rocker arms is simplified while adjustment potential is still maintained.

SUMMARY OF THE INVENTION

This invention is adapted to be embodied in the valve actuating mechanism for operating a single poppet valve of an engine through cooperation with the stem thereof. The valve operating mechanism is comprised of a single cam shaft having a pair of adjacent cams. A pair of adjacent, pivotally supported rocker arms, each cooperate with a respective one of the cams. A first of the rocker arms has an operating portion for direct cooperation with the valve stem for operating the valve. Means provide a selective, adjustable coupling of the second rocker arm to the first rocker arm for effecting actuation of the valve through the first rocker arm. This coupling includes a replaceable adjusting shim. Thus, by providing different characteristics of the cam and rocker arms, varying lift and/or duration can be achieved, adjustment is simplified and the construction can be more compact.

DETAILED DESCRIPTION OF THE PREFERRED EMBODIMENTS

Figure 1:
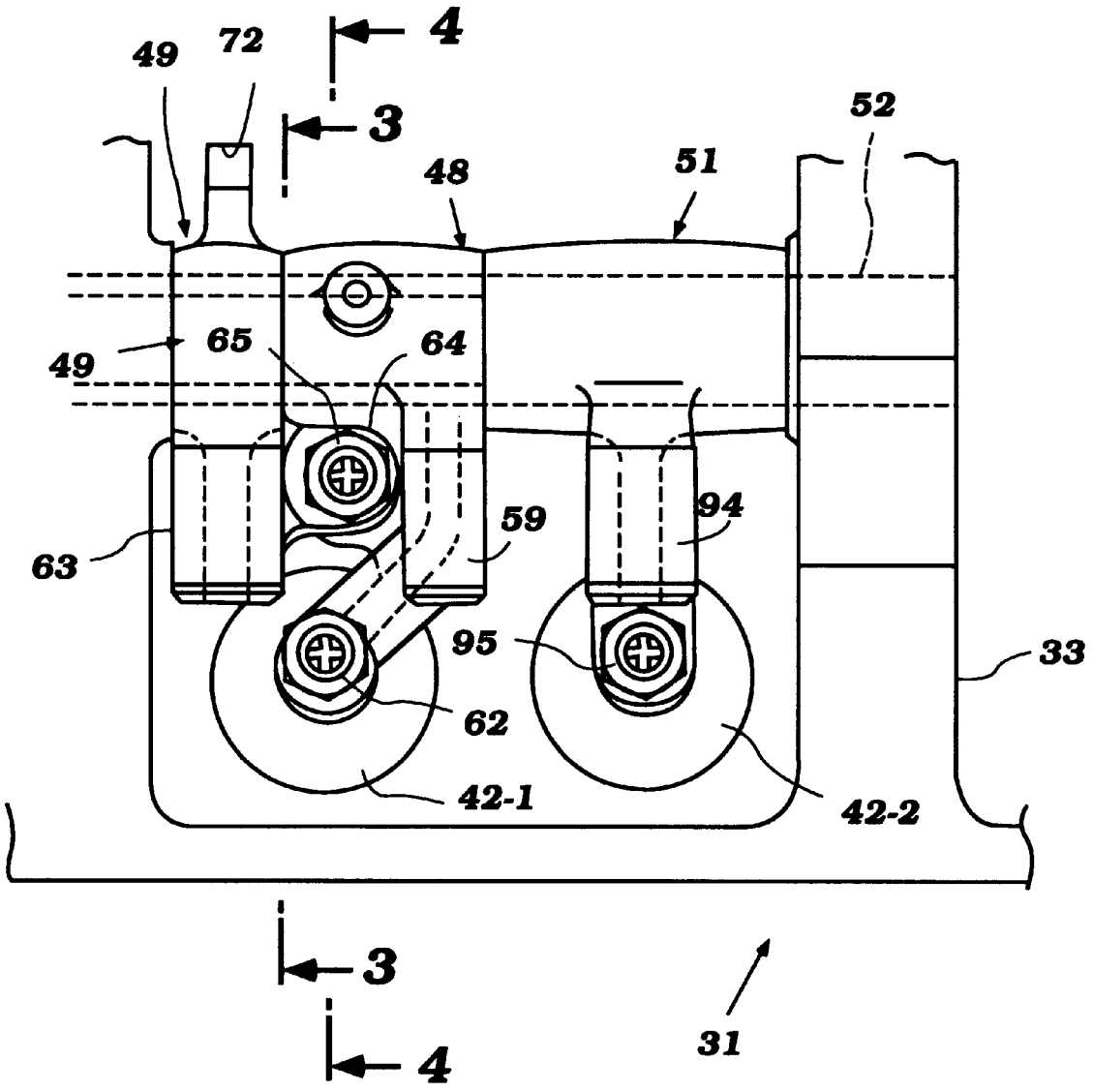
FIG. 1 is a top plan view looking at the valve actuating mechanism associated with a single cylinder of an internal combustion engine constructed in accordance with a first embodiment of the earlier invention, with the cam cover for the engine removed.

Before describing in detail all of the embodiments, it should be noted that the embodiments of FIGS. 1–10, 11, 12–20, and 21–23 are substantially the same as embodiments shown and described in the parent application. A description of these embodiments is incorporated herein, because the inventive structure, shown in detail in FIGS. 25 and 26 of this invention, can be utilized with any of the types of structures shown in the prior application. That is, and as will become apparent, the adjusting mechanism for adjusting the interrelationship between the first and second rocker arms rather than using adjusting screws, as illustrated in the mentioned embodiments can be replaced by the shim type adjusting arrangement shown in FIGS. 24 and 25.

Referring now in detail to the drawings and initially to the embodiment of FIGS. 1–10, a portion of a cylinder head assembly of an internal combustion engine is illustrated and is identified generally by the reference numeral 31. Only a portion of the engine is illustrated and specifically the cylinder head thereof because the invention deals, as aforenoted, with a valve actuating mechanism for engines. Therefore, when any details of the construction of the engine are not illustrated, they may be considered to be conventional. Those skilled in the art will be able to determine from the following description how the invention can be utilized with a wide variety of engines.

In all of the embodiments illustrated, the depicted engine and cylinder head 31 are of the four valve cylinder type. This is because the invention has particular utility with multi-valve engines, for reasons which will become apparent. However, the invention can be utilized with engines having any number of valves including only two valves per cylinder or more than two valves in any number.

The cylinder head assembly 31 includes a main cylinder head member 32 which has an upper surface which carries a bearing and cam carrier 33 and which is closed by a cam cover 34.

As best seen in FIGS. 3–5 and 10, each cylinder of the engine is served by a pair of intake passages 35 that terminate in valve seats 36 which are valved by poppet-type intake valves, indicated generally by the reference numeral 37. These valves 37 have head portions 38 that cooperate with the valve seats 36 and stem portions 39 that are slidably supported in valve guides 41 affixed to the cylinder head member 32.

At their upper ends, keeper retainer assemblies 42 retain spring assemblies 43 that act between the keeper retainer assemblies 42 and the cylinder head for biasing the valves 37 to their closed positions, as is well-known in this art.

Figure 2:
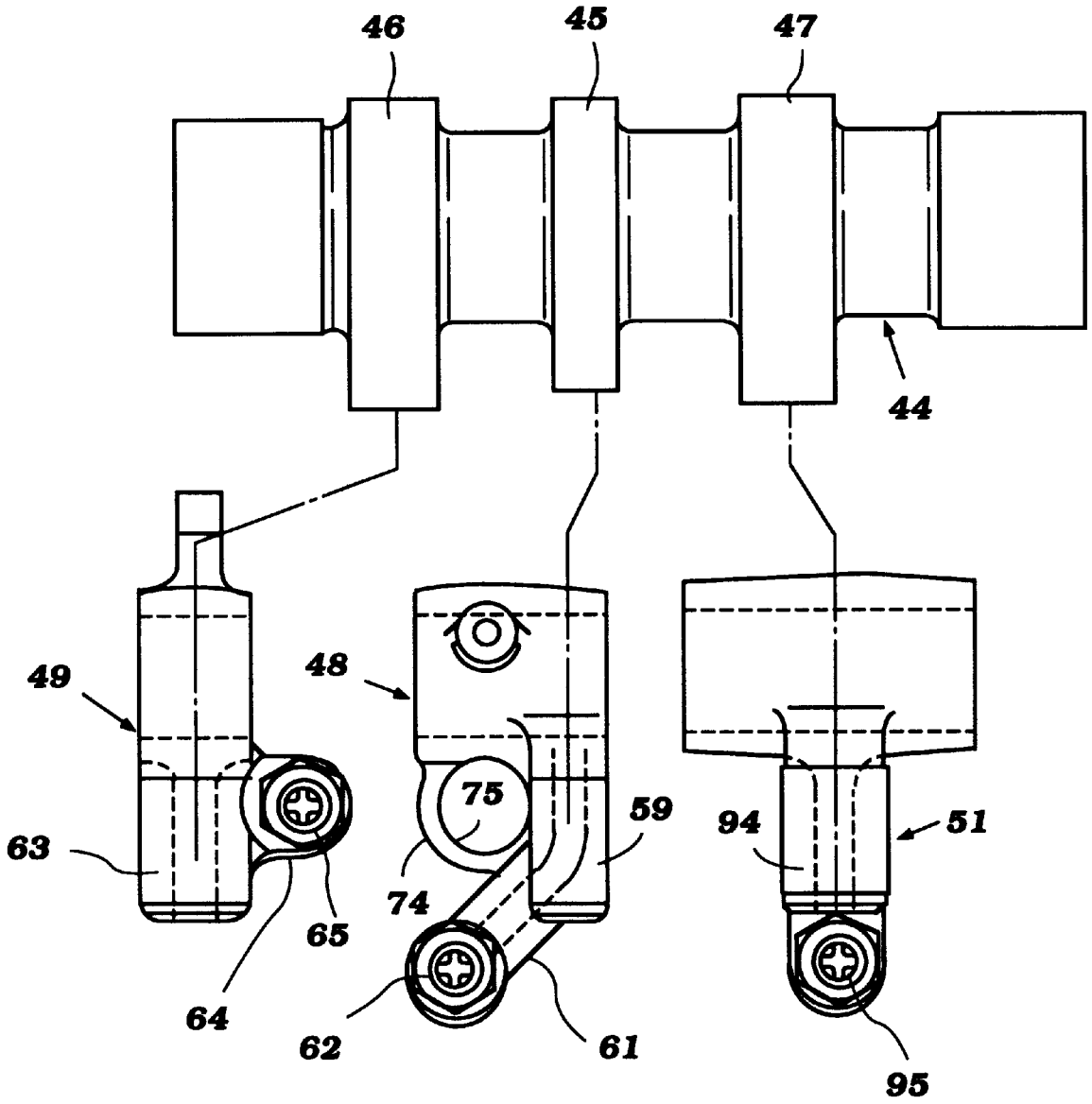
FIG. 2 is an exploded view showing the same components illustrated in FIG. 1 but illustrating only the cam shaft and the rocker arms associated therewith.

Referring now primarily to FIGS. 1 and 2, a cam shaft, indicated generally by the reference numeral 44, is journaled in the cam carrier 43 by bearing surfaces formed by it and bearing caps which are not illustrated. The cam shaft 44 has three lobes comprised of a first, center lobe 45, a second lobe 46, and a third lobe 47. Associated with these lobes 45–47 are first, second and third rocker arms, indicated generally by the reference numerals 48, 49 and 51. These rocker arms 48, 49 and 51 are all journaled on a common rocker arm shaft 52 that is carried by the cam carrier member 33 in any known manner.

As may be best seen from FIG. 1, the cam lobes 45 and 46 and their cooperating rocker arms 48 and 49 are associated with one of the valves 37, the keeper retainer of which is indicated by the reference numeral 42-1. The remaining cam lobe 47 and rocker arm 51 are associated with and operate the remaining intake valve 37 and their association is indicated by the reference numeral 42-2, which identifies the keeper retainer of this remaining valve.

The first rocker arm 48 is a rocker arm which, under all conditions, operates the associated intake valve having a retainer 42-1. This rocker arm 48 has a follower portion 59 which is engaged with the cam lobe 45 and which is actuated by it. An actuating portion 61 extends integrally outwardly from the area adjacent the cam follower 59 and carries an adjusting screw 62 at its outer end which cooperates with the tip of the stem 39 of the associated valve. Thus, this rocker arm generally operates as a conventional rocker arm for the valve actuation during such time as the second rocker arm 49 is not coupled to it. This coupling method will be described later.

Figure 3:
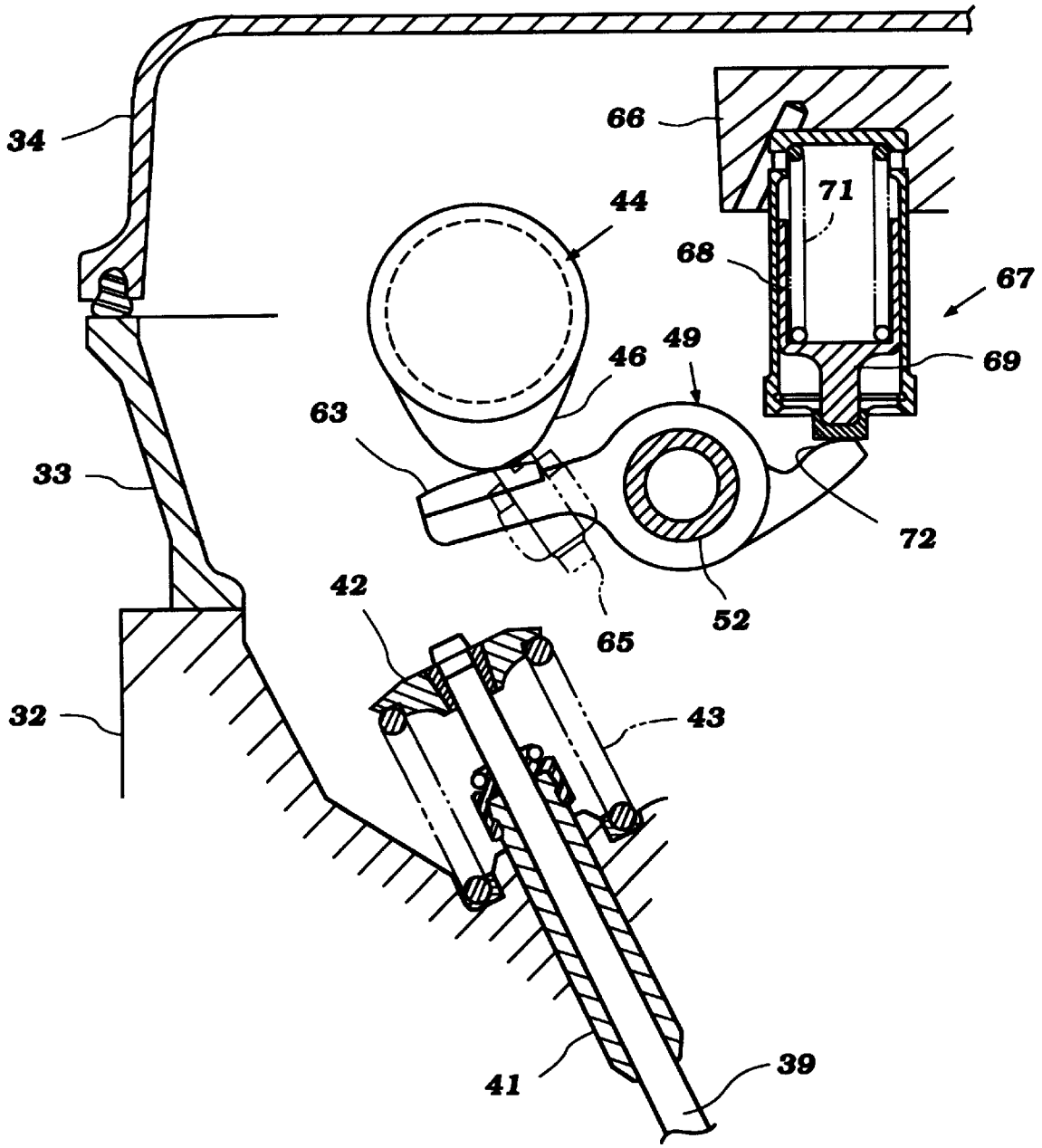
FIG. 3 is a cross-sectional view taken along the line 3—3 of FIG. 1 and illustrates one of the rocker arms and its association with the cam shaft.

Referring now primarily to FIGS. 1–3, the second rocker arm 49 and its cooperation with the cam lobe 46 will be described. The rocker arm 49 has an outwardly extending arm which forms an integral follower 63 that is engaged by the cam lobe 46. At this point, it should be noted that the cam lobe 46 is of a larger lift and larger diameter than that of the cam lobe 45. This is readily apparent from FIG. 10. In addition to providing a different lift, this cam lobe 46 may also be configured to provide slightly different timing through its cooperation with the first rocker arm 48.

Adjacent the follower surface 63, the rocker arm 49 is provided with a protrusion 64 that receives an adjusting screw 65. This adjusting screw 65 operates in conjunction with a coupling mechanism to, at times, control the operation of the first rocker arm 48. That mechanism will be described very shortly.

In order to maintain the rocker follower surface 63 in engagement with the cam lobe 46, a biasing arrangement shown in FIG. 3 is provided. As seen in this Figure, a spring carrier 66 is affixed to the cam carrier 33 in a known manner. The spring carrier 66 is provided with a plurality of pockets, one for each rocker arm 49. A spring arrangement, indicated by the reference numeral 67, is supported in each of these pockets.

The spring arrangement includes an outer cylinder member 68 which defines a bore in which a sliding biasing member 69 is provided. The sliding biasing member 69 is biased by a coil compression spring 71 into engagement with a further follower surface 72 formed on a portion of the rocker arm 49 that extends in somewhat diametrical opposition to the portion that forms the follower surface 63. Thus, the spring 71 acting through the biasing member 69 and rocker arm surface 72 will maintain the rocker arm follower 63 in engagement with the cam lobe 46.

The mechanism for selectively coupling the rocker arm 49 to operate the rocker arm 48 will now be described by particular reference to FIGS. 4–10. FIGS. 4 through 7 show this coupling mechanism, which is indicated generally by the reference numeral 73, in the disengaged condition so that the first rocker arm 48 operates without any control or interference from the second rocker arm 43. Under this condition, the cam lobe 45 and first rocker arm 48 control the degree of maximum opening and timing of opening of the valve 37 with the fully-opened position being shown in FIG. 5.

The rocker arm 48 has a boss portion 74 that is formed adjacent its follower surface 59 but below it. A cylindrical bore 75 is formed in this boss 74. A coupling plunger member, having a configuration shown in FIGS. 4–10 and indicated generally by the reference numeral 76, is slidably supported within this bore. This coupling plunger member 76 has a head or top portion 77 which is positioned to be and is engaged during the running of the engine by the screw 65.

Figure 6:
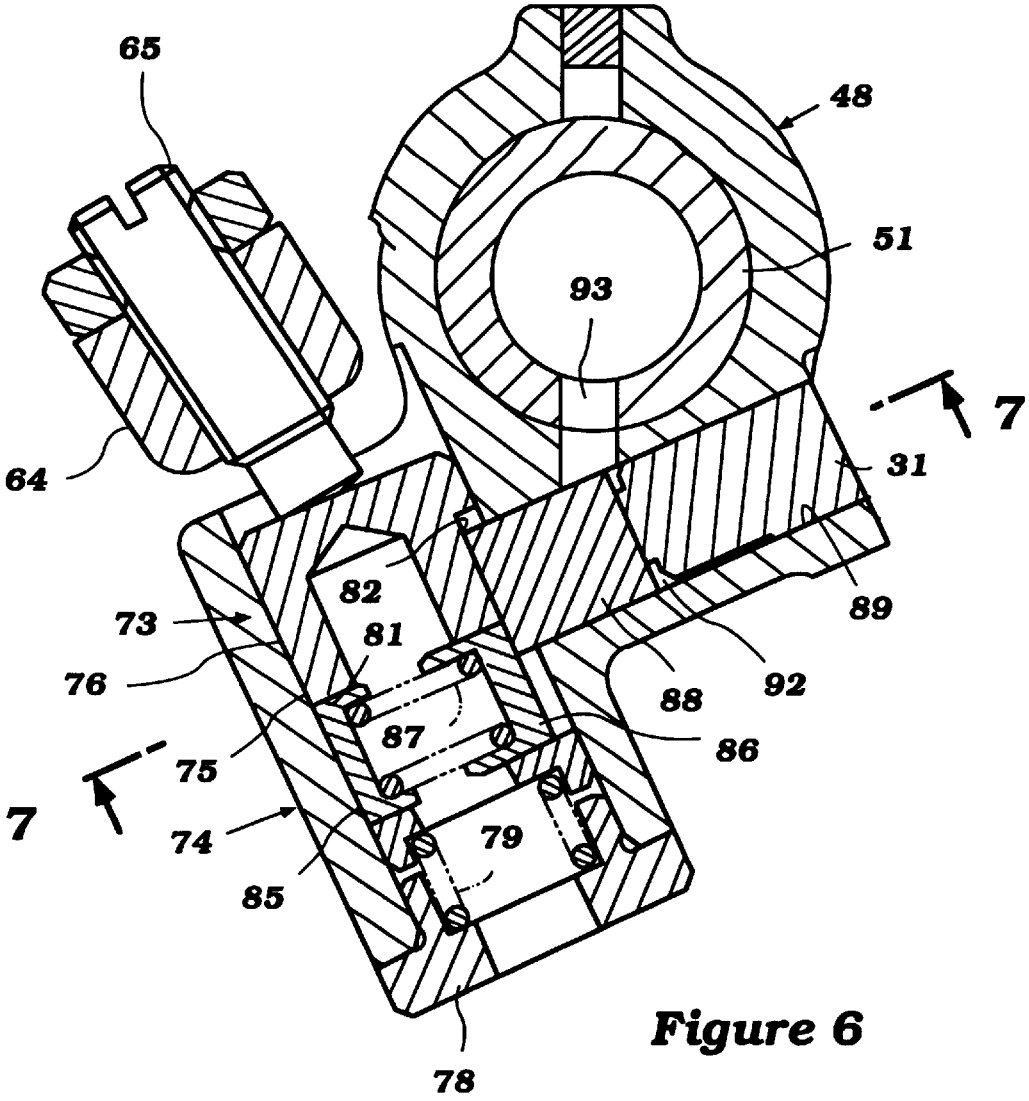
FIG. 6 is an enlarged cross-sectional view taken along the same plane as FIGS. 4 and 5, and shows the same condition in FIG. 4, i.e., with the valve closed.
Figure 7:
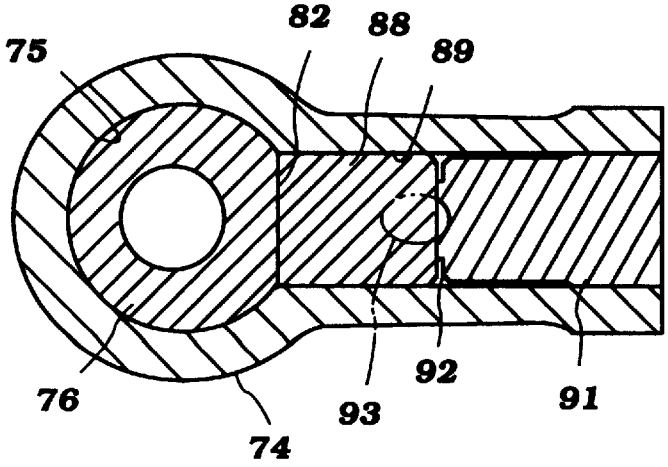
FIG. 7 is a cross-sectional view taken along the line 7—7 of FIG. 6.
Figure 8:
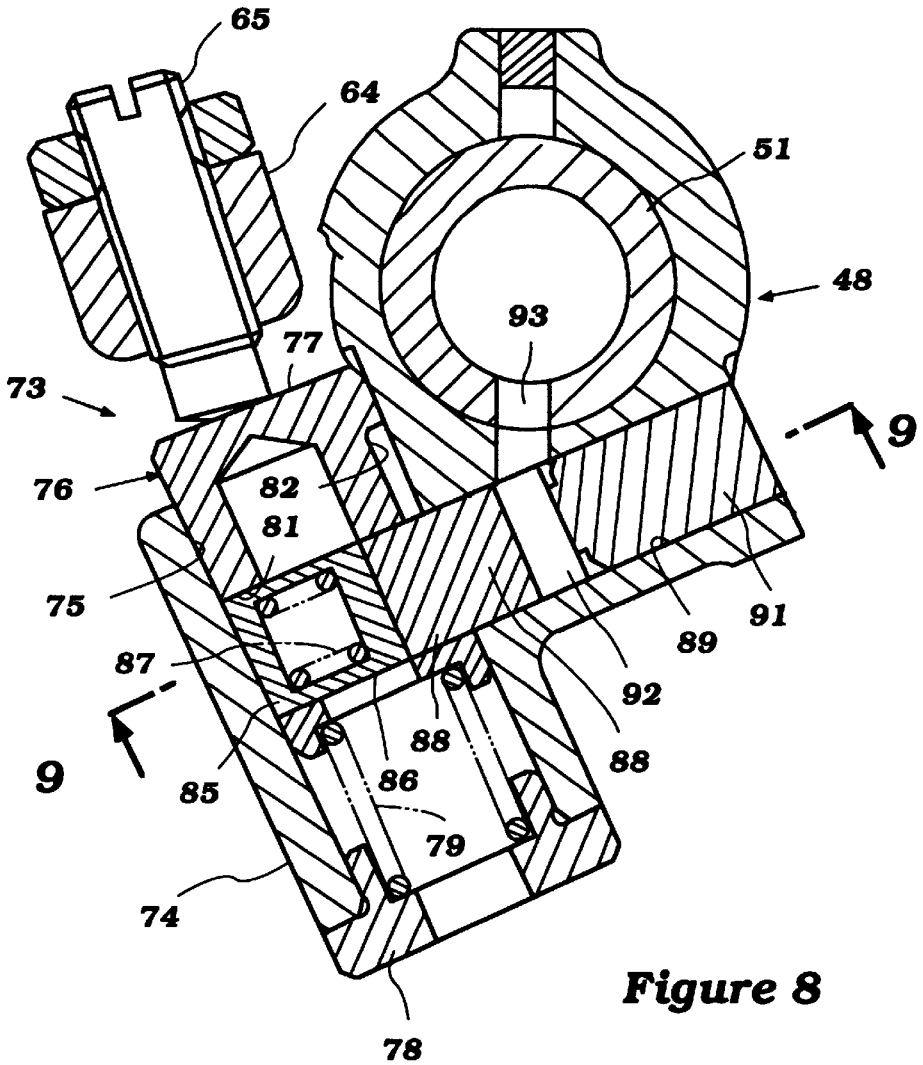
FIG. 8 is a cross-sectional view taken along the same plane as FIG. 6 and shows the arrangement when the second rocker arm is coupled to the first rocker arm and is effective to operate the first rocker arm and the valve therethrough.

As may be best seen in FIGS. 6 and 8, the lower end of the bore 74 is partially closed by a cap 78 which forms an engagement for a biasing spring 79 that acts on the lower end of the coupling plunger member 76. This spring 79 keeps the coupling plunger member 76 and specifically its surface 77 in constant engagement with the adjusting screw 65. It should be apparent, however, that if desired, some clearance may be maintained in this gap depending upon how the valve operation is to be accomplished. Also in some views the position of the plunger member 76 in the bore may not be the true position depending upon the lift characteristics of the respective cams 45 and 46 and specifically that of their lobes.

The coupling plunger member 76 is formed with a bore 81 that extends from a flat surface 82 formed in a side thereof by a machined recess 83. Received within the bore 81 is a return spring arrangement that is comprised of a pair of end caps 85 and 86 that are urged apart by a coil compression spring 87.

In the uncoupled state when only the cam 45 is operating the valve 37, this compression spring 87 causes the retaining member 83 to be urged to a position where a flat surface of it is coextensive with the surface 82. Under this condition the surface 82 is engaged by a slidable locking member 88.

The locking member 88 is slidably supported within a bore 89 that extends through the rocker arm 48 below its journal on the rocker arm shaft 51. The outer end of this bore 89 is closed by a closure plug 91 and in the uncoupled state, the locking member 88 is abuttingly engaged with this closure plug 91.

Figure 4:
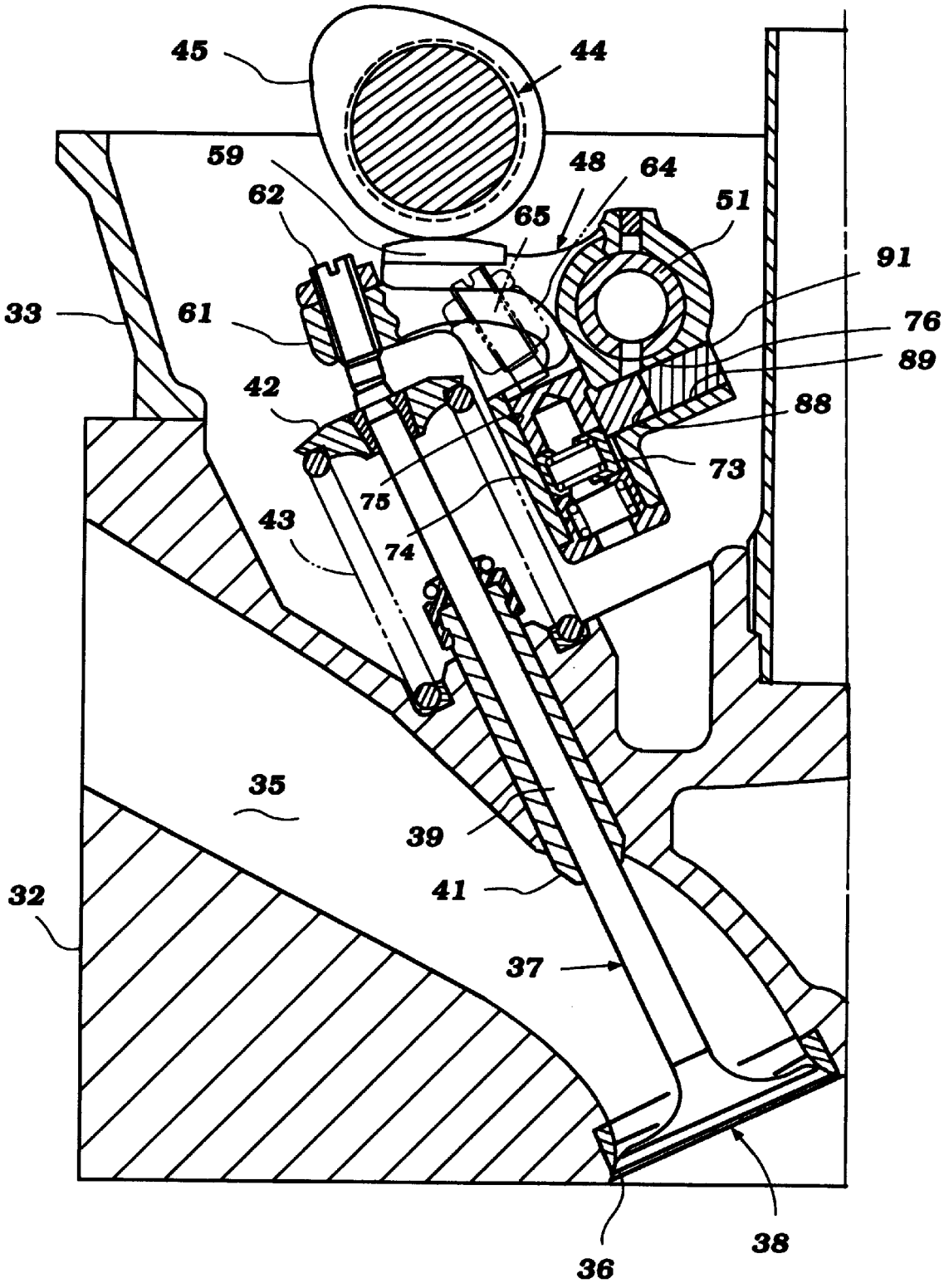
FIG. 4 is a cross-sectional view taken along the line 4—4 of FIG. 1 and shows the valve in its closed position.
Figure 5:
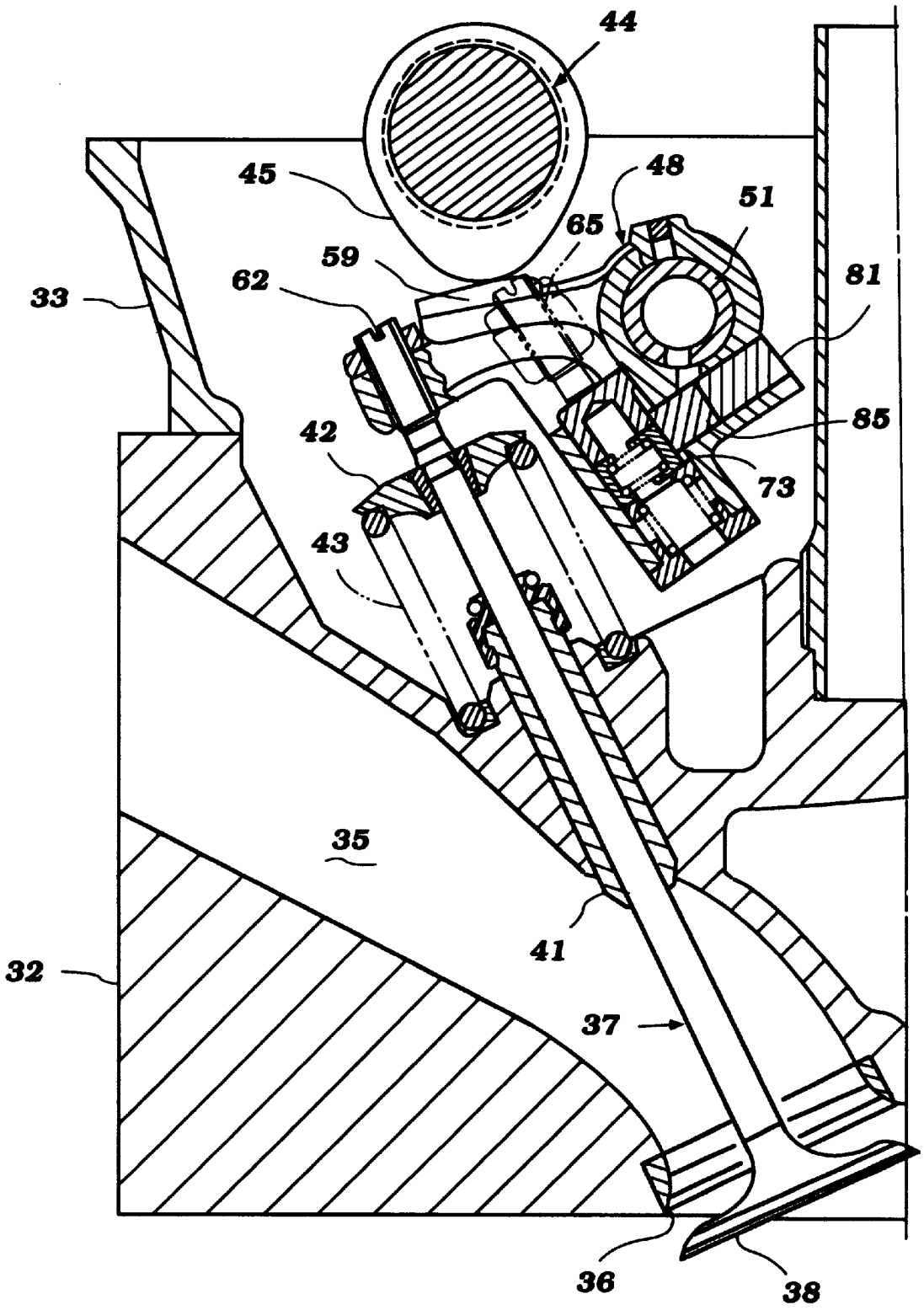
FIG. 5 is a cross-sectional view, in part similar to FIG. 4, and shows the valve in its open position when opened by the first rocker arm.

The cooperation of the locking member 88 with the side of the surface 82 will permit reciprocation of the coupling plunger member 76 in the bore 75 between the position shown in FIG. 4 which represents the closed condition and the position shown in FIG. 6 which shows the condition when the intake valve 37 is opened to its maximum lift during the time when the cam lobe 45 is operating the rocker arm 48 so as to control the timing and lift of the valve 37. Rotation of the plunger member 76 in the bore 75 is, however, precluded by this co-action.

When the cam lobe 46 operates the rocker arm 49 to begin its lift, then the coupling plunger member 76 will be driven downwardly in the bore 75 as shown in FIG. 6. Under this condition, no additional movement of the rocker arm 48 will occur and thus there is lost motion under this operation.

It should be noted that in the retracted position of the locking member 88, a gap 92 is provided between it and the end closure 91. This gap communicates with an oil control passage 93 that extends through the rocker arm shaft 51 and rocker arm 48. The rocker arm shaft 51 is hollow and hydraulic fluid pressure may be exerted selectively through this passage 73 to the area 92 in accordance with a desired control strategy. One such strategy will be described later by reference to the embodiment of FIG. 11.

Figure 9:
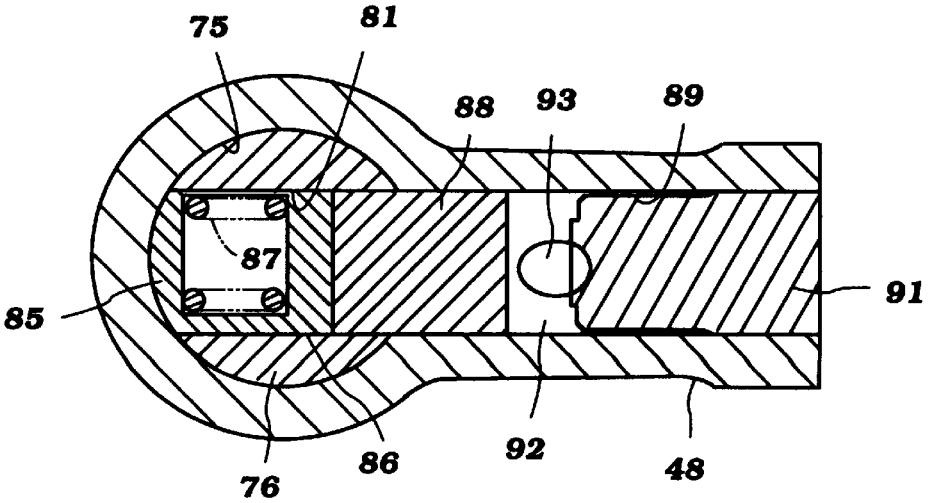
FIG. 9 is a cross-sectional view taken along the line 9—9 of FIG. 8.
Figure 10:
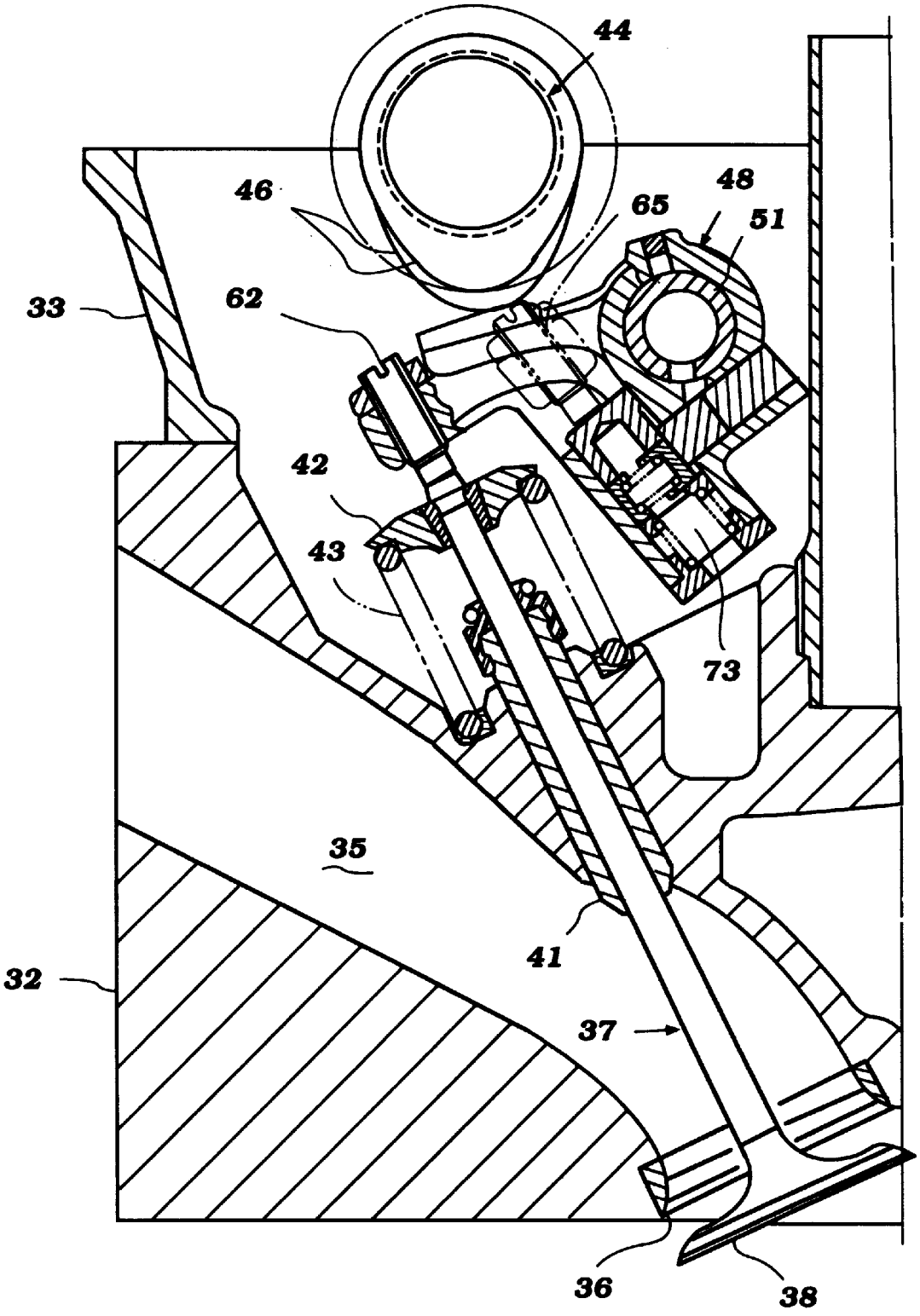
FIG. 10 is a cross-sectional view, in part similar to FIGS. 4 and 5, but shows the valve in its fully opened position when operated by the second rocker arm acting through the first rocker arm.

When this passage 93 is pressurized, as shown in FIGS. 8 and 9, the locking plunger 83, when it registers with the bore 81, will act on the retainer member 86 and force it inwardly and compress the spring 87. At this time, the rocker arms 48 and 49 will be coupled together and the rocker arm 49, because of its greater lift and timing, will actually control the opening degree of the valve so as to provide a greater lift under this coupled condition as clearly shown in FIG. 10. By comparing FIG. 10 with FIG. 5, this greater lift condition can be readily appreciated When the hydraulic pressure in the passage 93 and area 92 is relieved, the spring 87 will urge the locking plunger 88 back to its disengaged position as shown in FIGS. 4–7.

Referring back to FIGS. 1 and 2, it will be seen that the rocker arm 51 and cam lobe 47 that operate the remaining intake valve which does not have its lift varied in this embodiment. The rocker arm 51 has a follower surface 94 that is engaged by the cam lobe 47. An adjusting screw 95 carried at the tip of this rocker arm cooperates with the stem of this valve to operate it in a normal manner. Varying types of lift arrangements may be employed and different lift ratios and/or valve timing between the non-variable actuated valve and the variable actuated valve. That is the lift and/or timing of the valve operated by the cam 47 may be the same as that provided by either of the cams 45 or 46 associated with the other valve or different from either of them.

Figure 11:
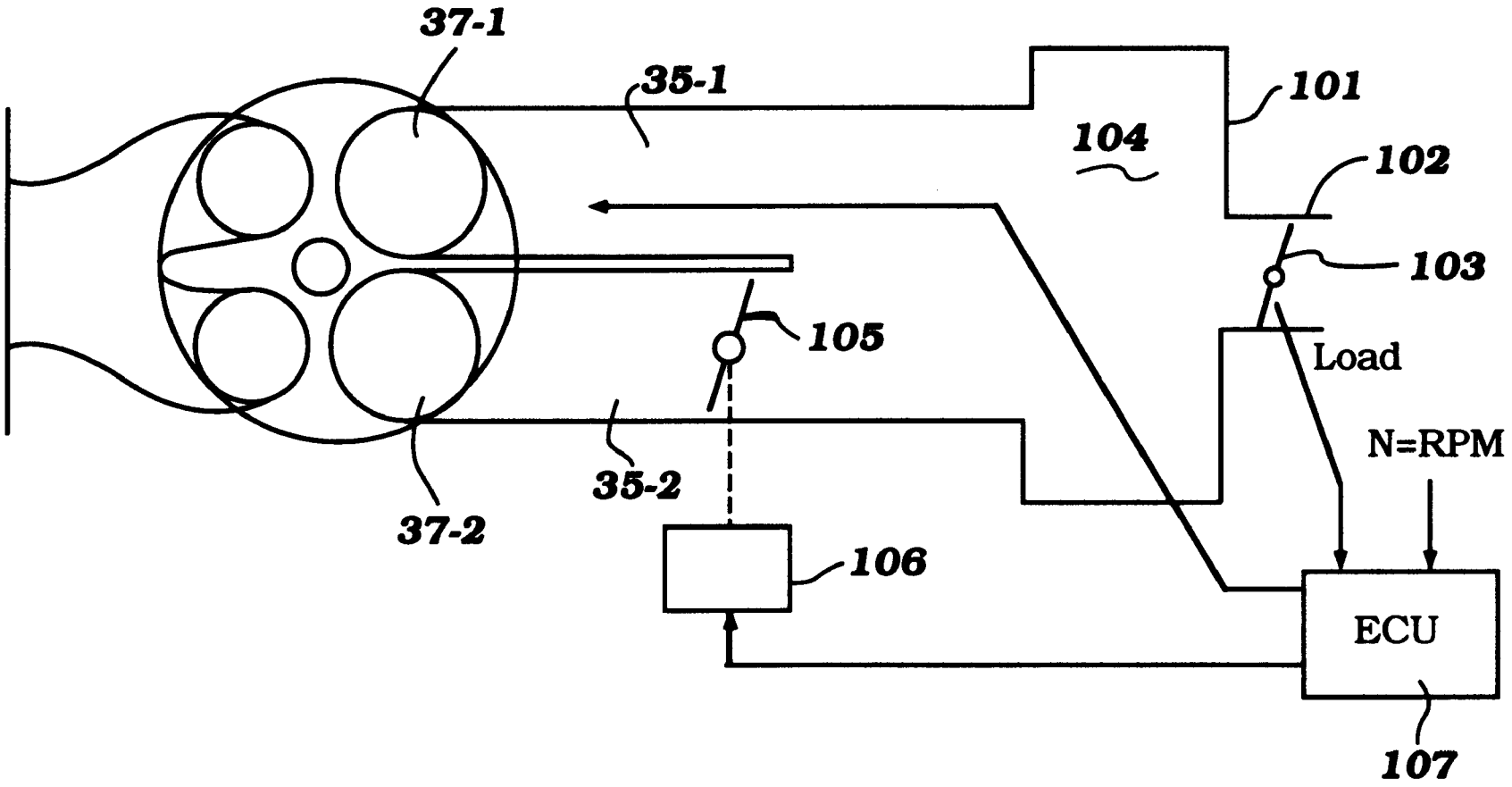
FIG. 11 is a partially schematic view showing an induction system for the engine and an ancillary intake control system that may be utilized in conjunction with the various valve operating embodiments disclosed herein.

FIG. 11 is a view that shows one way in which this mechanism may operate. This view shows the induction system schematically and it now will be described by reference to that Figure. In this Figure, the normally or non-variably actuated valve is indicated by the reference numeral 37-2, while the variably actuated valve is indicated by the reference numeral 37-1. The intake passages 35 associated therewith have also been indicated by the same suffixes, i.e., 35-2 and 35-1.

In accordance with this embodiment, an air inlet device, indicated by the reference numeral 101, draws atmospheric air through an inlet opening 102 in which a manually actuated throttle control valve 103 is positioned. The air inlet device 101 forms a plenum chamber 104 that communicates with the runners 35-1 and 35-2 of each cylinder.

A control valve 105 is provided in the runner 35-2 and is operated by a servo motor 106 under the control of an ECU, indicated generally by the reference numeral 107.

In this embodiment, the intake valve 37-1 and its operation is adjusted to optimize primarily the low and mid-range performance of the engine. Thus, the cam lobe 45 and rocker arm 48 can be tailored for optimum performance under low-speed and low-mid range running. The cam lobe 46 and rocker arm 49 are coupled for a higher range of operation and may provide a substantially greater lift so as to improve the performance under higher speeds and loads.

Thus, the control strategy for the ECU is to sense throttle position or load and engine speed and be mapped so as to activate the servo motor 106 and maintain the throttle valve 105 in a closed position during low-speed and low-to-medium mid-range running.

As the speed and load increase, however, then the ECU effects opening of the control valve 105 by the servo motor 106. Thus, the engine can provide very good performance under a wide variety of speeds and loads due to the use of the variable valve actuating mechanism and the control valve 105.

The foregoing example is only one type of strategy that can be employed and the maximum lift for the valves 37-1 and 37-2 can be either the same or different depending upon the particular engine and tuning arrangement selected, as already noted.

Figure 12:
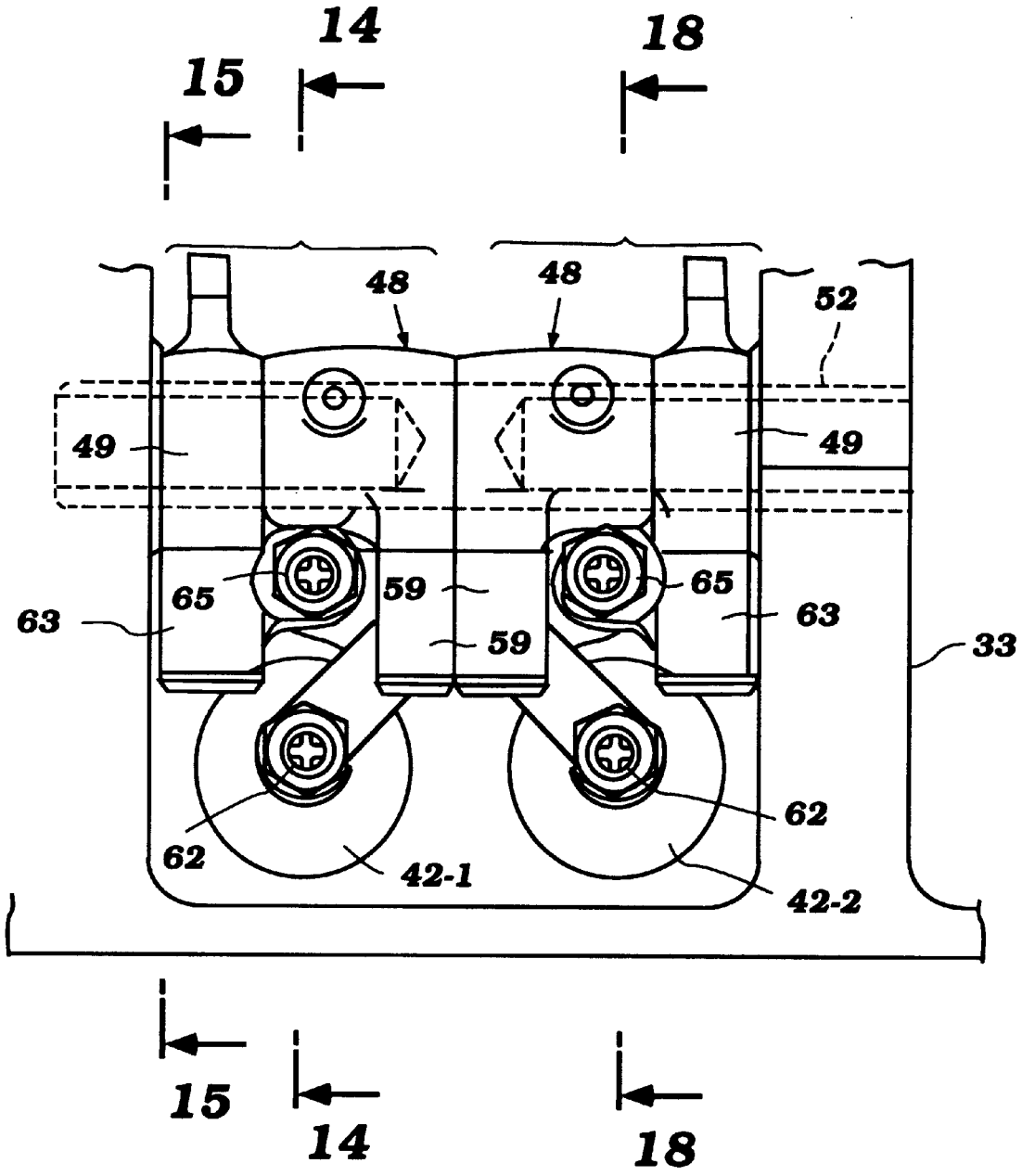
FIG. 12 is a view, in part similar to FIG. 1, and shows another embodiment of the prior invention where both valves of the same cylinder are operated by variable valve actuating mechanisms.
Figure 13:
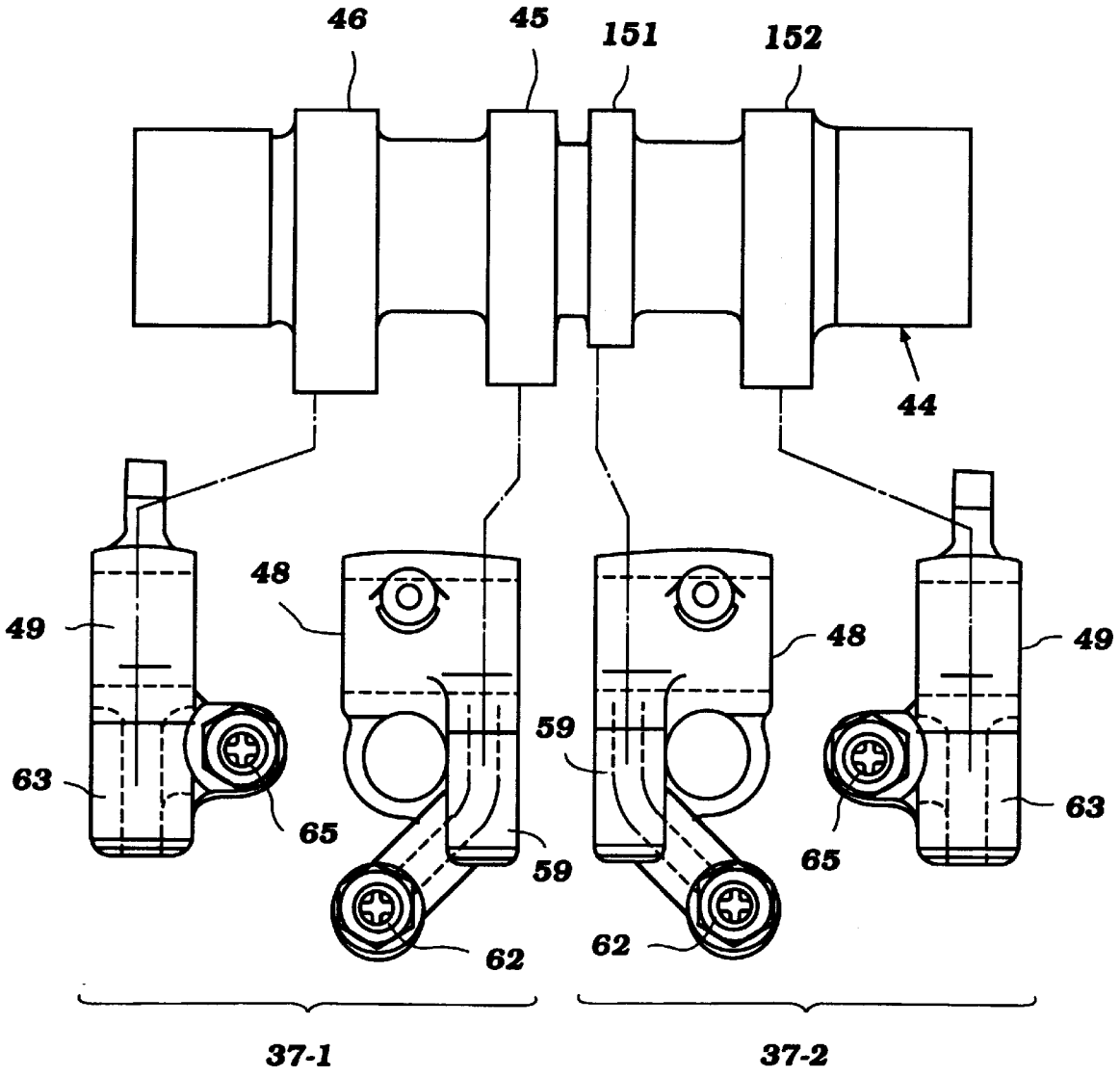
FIG. 13 is a partially exploded view, in part similar to FIG. 2, but shows the cam shaft and rocker arms of this embodiment.
Figure 20:
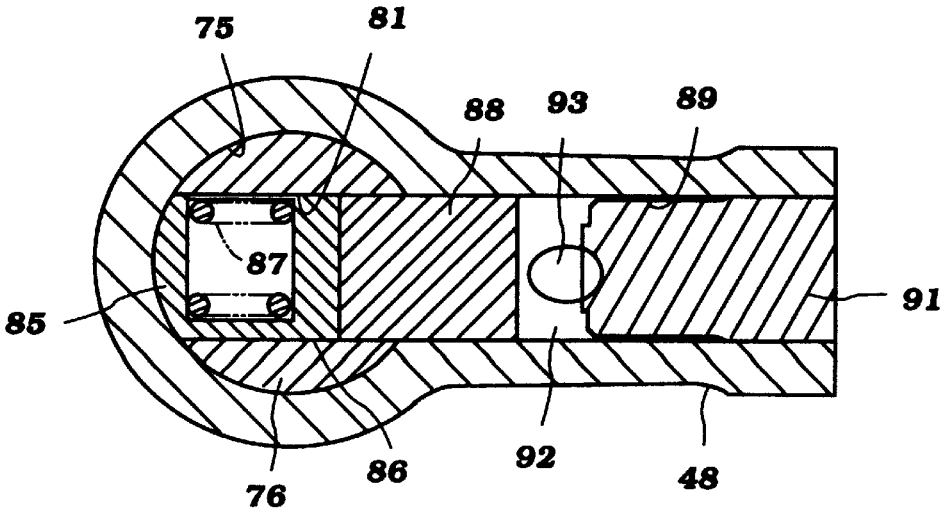
FIG. 20 is a cross-sectional view taken along the line 20—20 of FIG. 19.

FIGS. 12 and 20 show another embodiment of the invention wherein both of the intake valves 37-1 and 37-2 are provided with a variable valve actuating mechanism. In this particular embodiment, the cam shaft is provided with, in addition to, the lobes 45 and 46, for actuating the first intake valve 37-1, with additional lobes 151 and 152 for operating the rocker arms 48 and 49 associated with the remaining valve 37-2.

Figure 14:
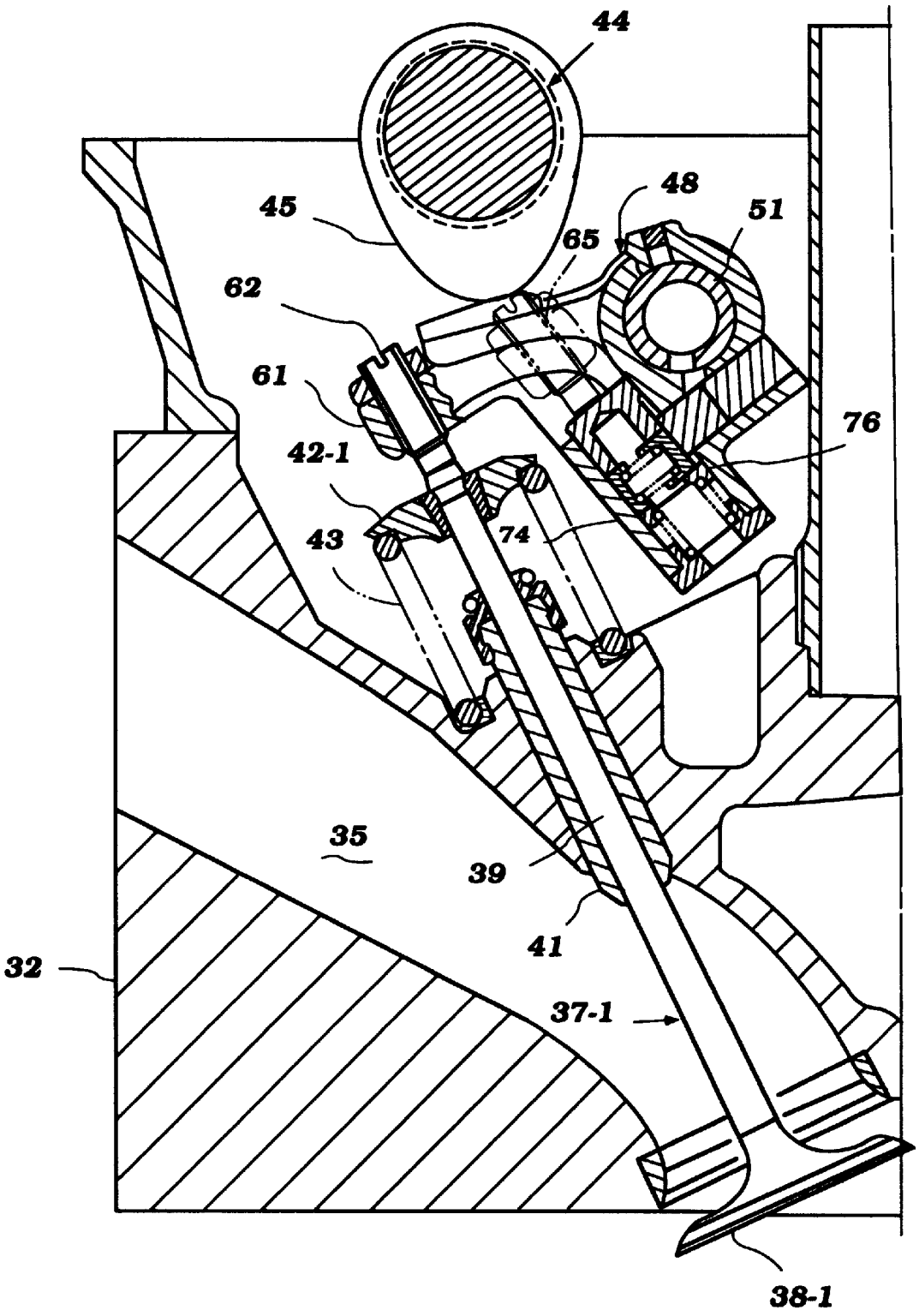
FIG. 14 is a cross-sectional view taken along the line 14—14 of FIG. 12 and shows this intake valve in its opened position when opened by the first cam lobe.
Figure 15:
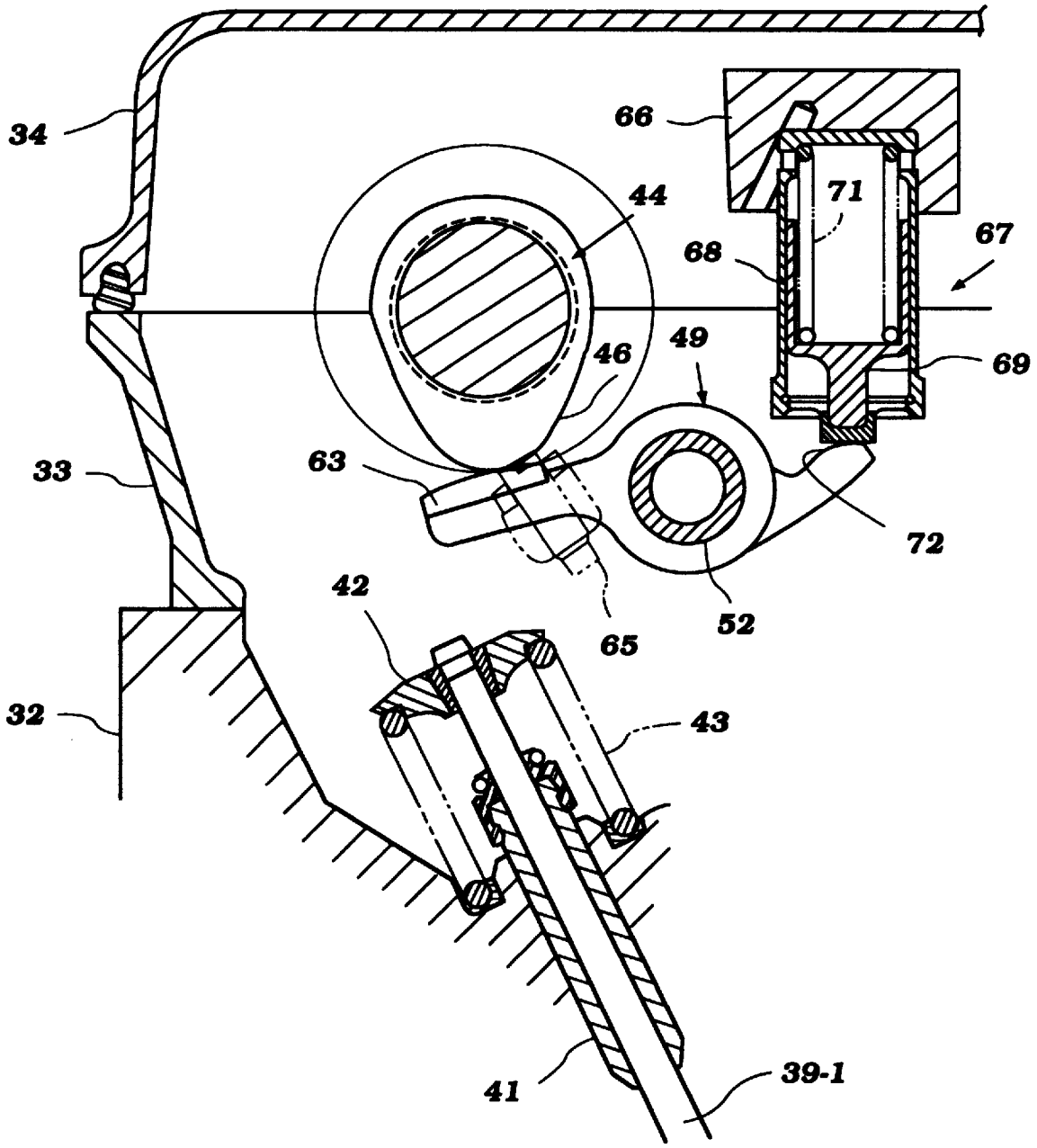
FIG. 15 is a cross-sectional view taken along the line 15—15 of FIG. 12 and shows when the first intake valve is opened by the second cam lobe.
Figure 16:
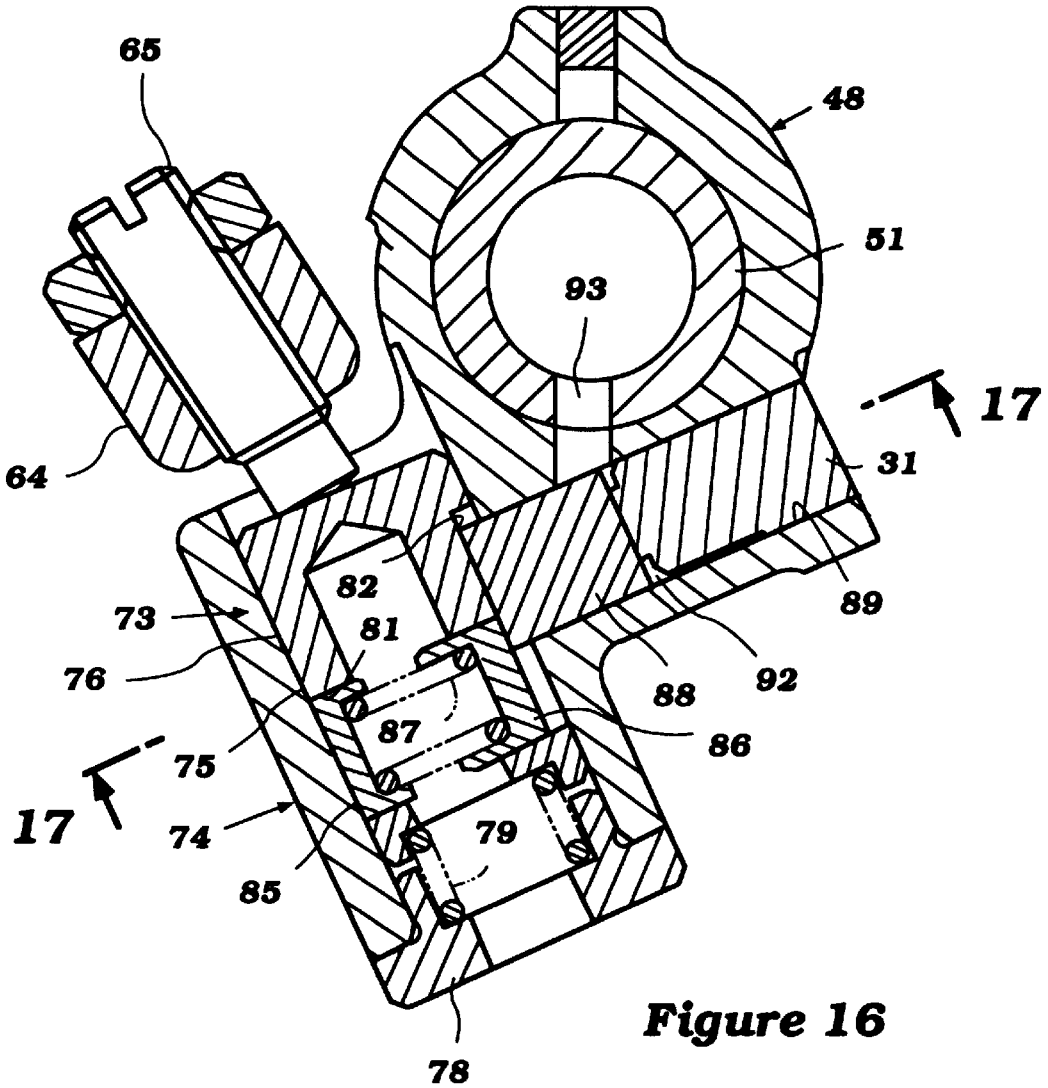
FIG. 16 is an enlarged cross-sectional view taken along the same plane as FIG. 14, but shows the operating mechanism when the valve is being opened by the first cam lobe.
Figure 17:
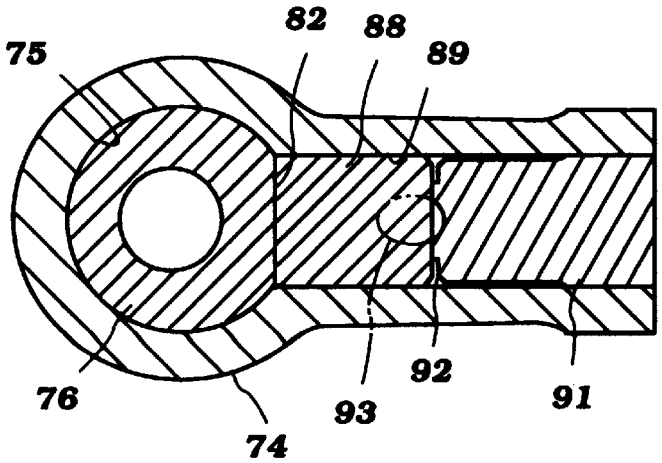
FIG. 17 is a cross-sectional view taken along the line 17—17 of FIG. 16.
Figure 18:
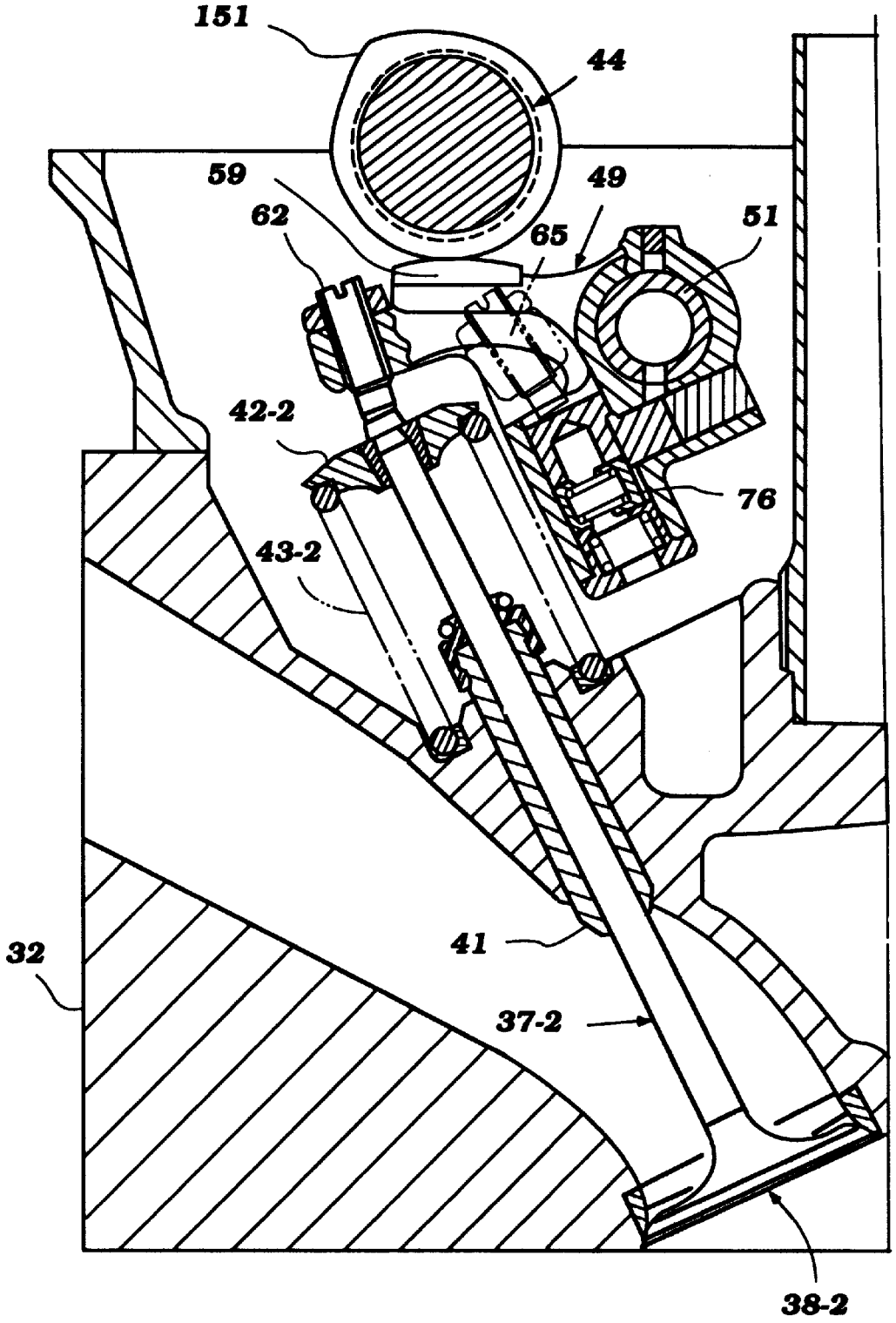
FIG. 18 is a cross-sectional view taken along the line 18—18 of FIG. 12 showing the second intake valve closed.
Figure 19:
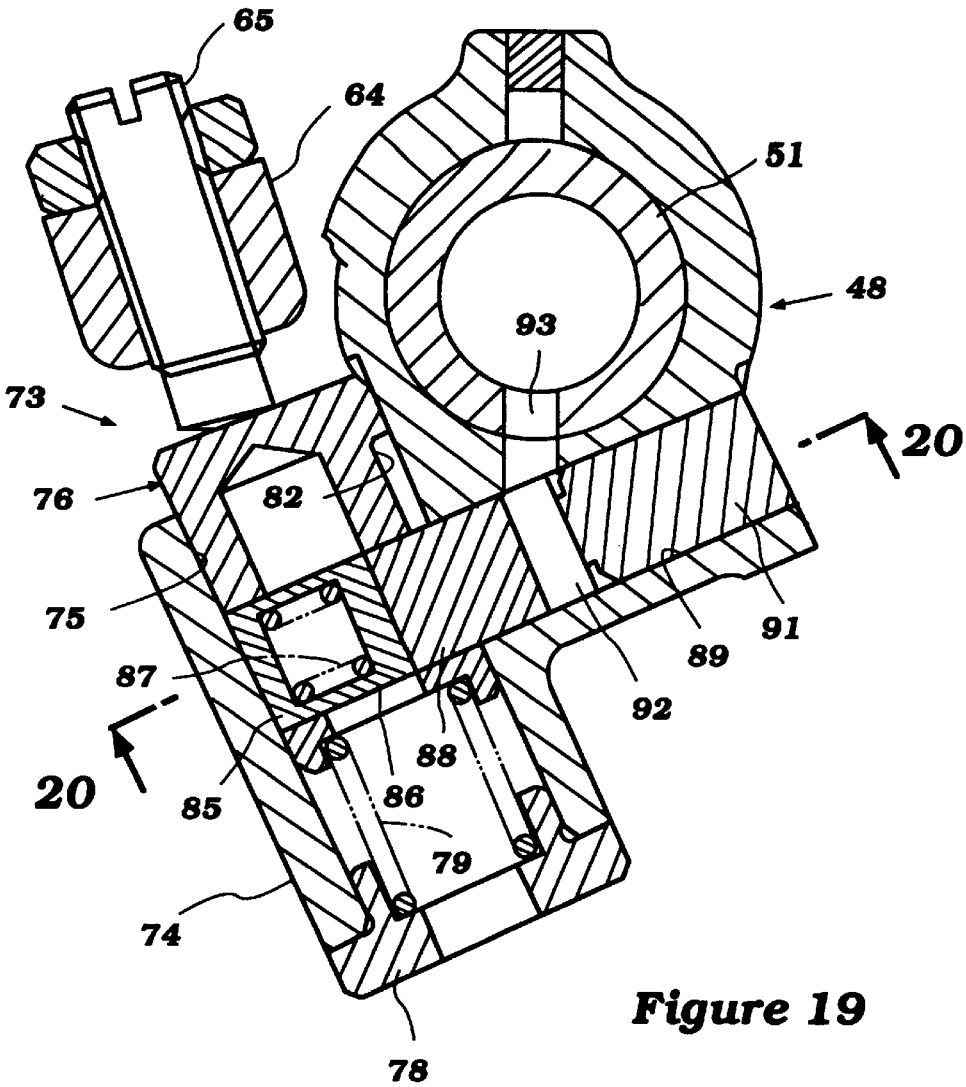
FIG. 19 is an enlarged cross-sectional view taken along the same plane as FIG. 18 and shows the valve actuating coupling arrangement between the second rocker arm and the valve.

It should be noted that the rocker arms 48 and 49 associated with the second intake valve 37-2 are mirror images so as to permit the two rocker arms 48 to be positioned next to each other and the other two rocker arms to be spaced more widely with this type of arrangement, as shown, the initial lift for the valve 37-2 is less than that of the valve 37-1 but the maximum lift provided by the cam lobes 46 and 152 can be the same. In this embodiment, because the rocker arms associated with each of the valves 37-1 and 37-2 are the same as those associated with the primary valve of the embodiment of FIGS. 1–10, many of the figures showing this embodiment are the same as that previously described. Therefore, FIG. 14 is basically the same as FIG. 5; FIG. 15 is basically the same as FIG. 3; FIGS. 16 and 17 are basically the same as FIGS. 6 and 7 and FIGS. 19 and 20 are basically the same as FIGS. 8 and 9. Because of these similarities, it is believed that further description of this embodiment is not necessary to permit those skilled in the art to understand the construction and operation of this embodiment.

Figure 21:
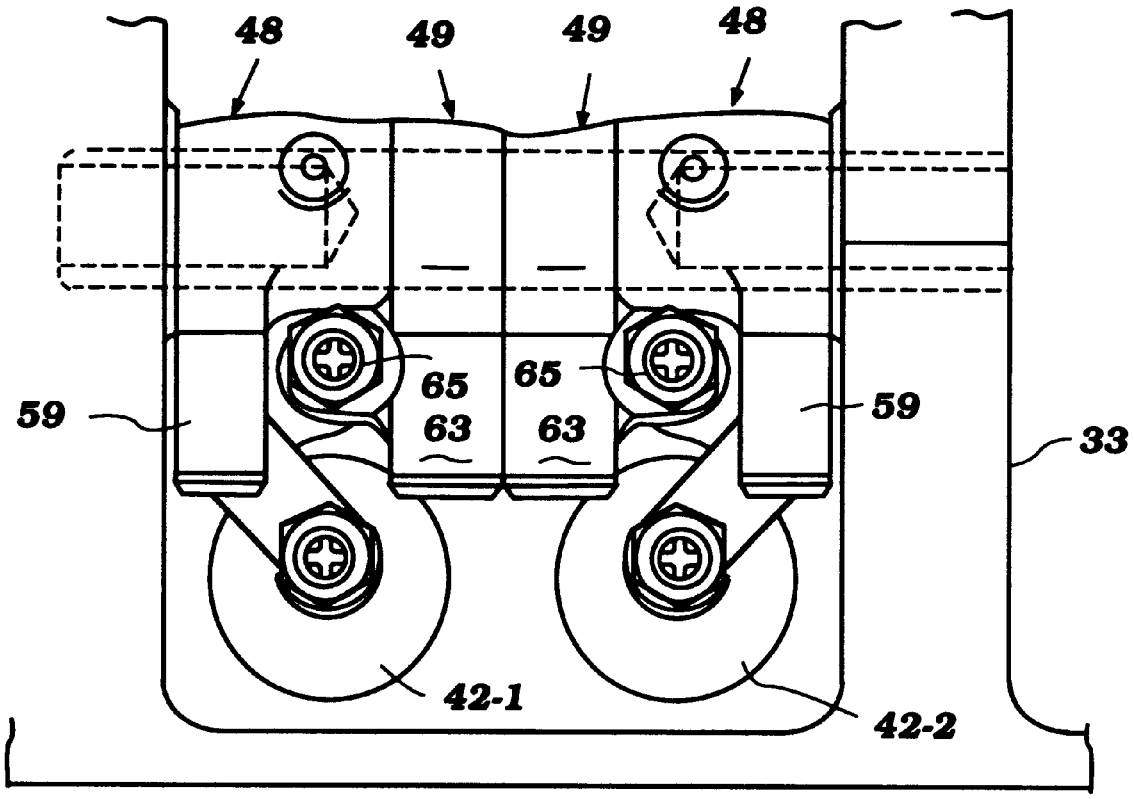
FIG. 21 is a top plan view, in part similar to FIGS. 1 and 12, and shows yet another embodiment of the prior invention mechanism employing variable valve actuating mechanism for both valves associated with a single cylinder of the engine.
Figure 22:
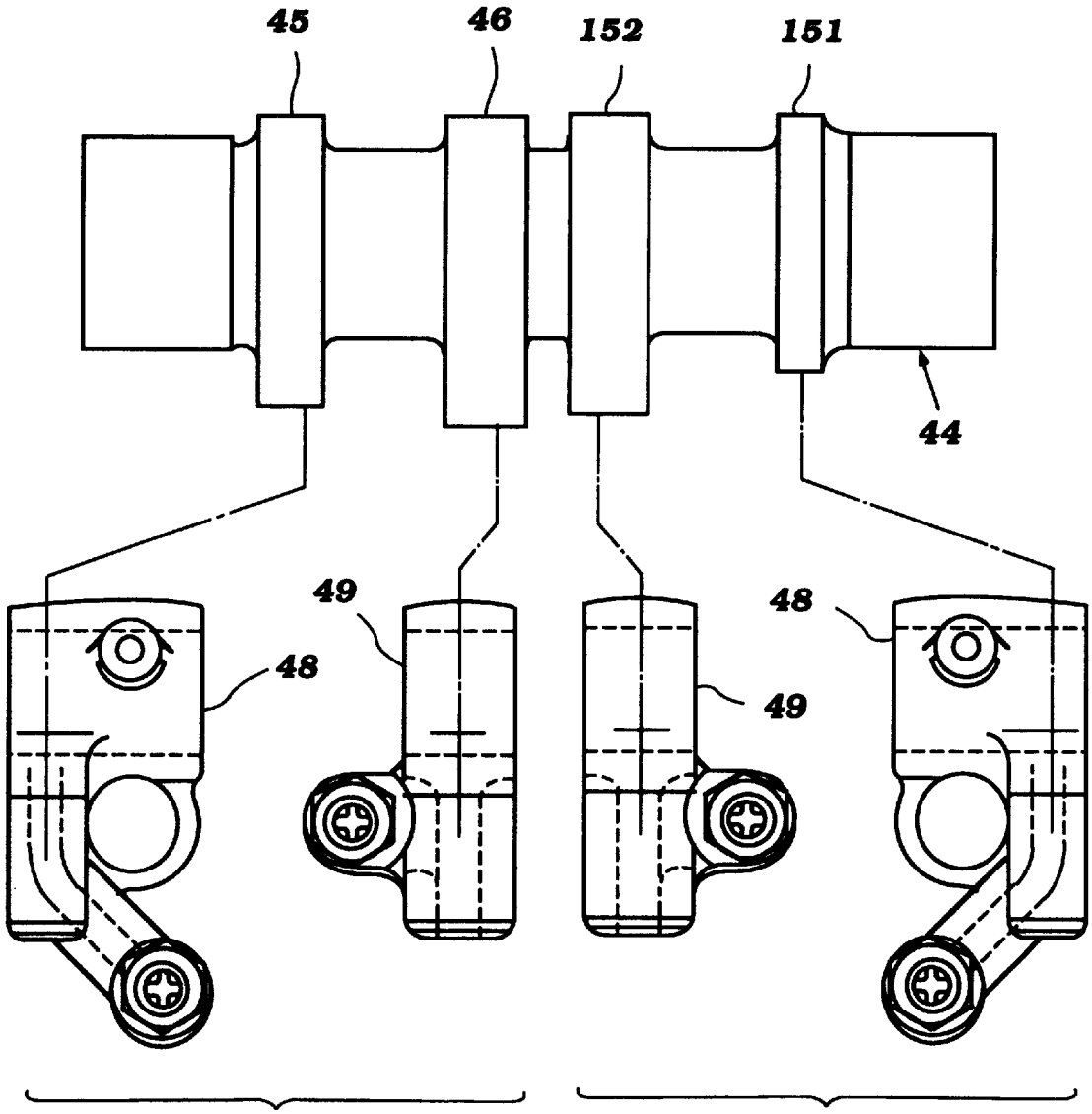
FIG. 22 is an exploded view, in part similar to FIGS. 2 and 13, but shows the cam shaft and rocker arms for this embodiment.
Figure 23:
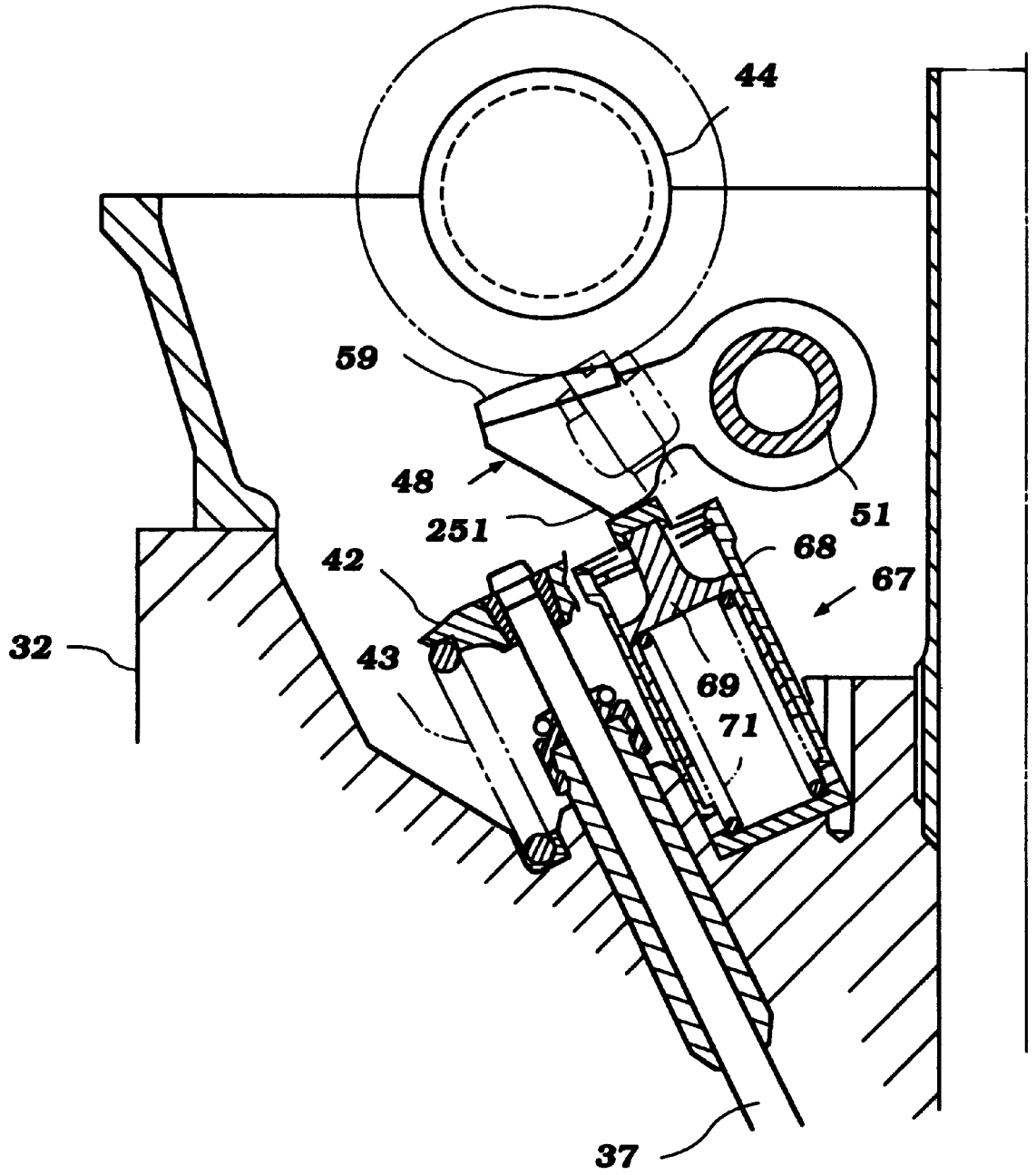
FIG. 23 is a cross-sectional view, in part similar to FIG. 3, but shows the other type of biasing arrangement for the second rocker arm used with this embodiment.

FIGS. 21–23 show yet another embodiment. In this embodiment, the rocker arms are reversed from the position utilized in FIGS. 12 through 21. That is, the direct actuating rocker arms 48 are disposed outwardly of the indirect acting rocker arms 49. Again, varying lift arrangements may be employed. As illustrated in this embodiment, the initial lift of the valve 37-1 is substantially greater than that of the remaining valve 37-2 while the maximum lift also is larger but only slightly larger as indicated by the respective cam lobe portions.

FIG. 23 also shows a different biasing arrangement for the second rocker arms that is like that used in the embodiment of FIG. 15. Since these are the only main differences from former embodiments, components which are the same or substantially the same have been identified by the same reference numerals.

In this embodiment, the second rocker arms 48 have, on the opposite side from their follower surfaces 59, a protruding portion 251 that is engaged by a spring return mechanism which is in essence the same as that employed in and shown in detail in FIG. 3. However, this return mechanism 67 is mounted directly in the cylinder head member 32 rather than on the cam carrier 33. In all other regards, this embodiment is the same and thus, further description of it is not believed to be necessary to permit those skilled in the art to practice the invention.

In each of the embodiments described, in order to permit a compact assembly, obviously the adjusting screw 65 and its associated rocker arm must be configured in relation to the cam lobes and specifically the cam lobe 45, so as to not present any interference. This has some spatial disadvantages. It also dictates that the follower surfaces of the rocker arms 59 and 63 must be relatively narrow in order to permit a compact construction.

Figure 24:
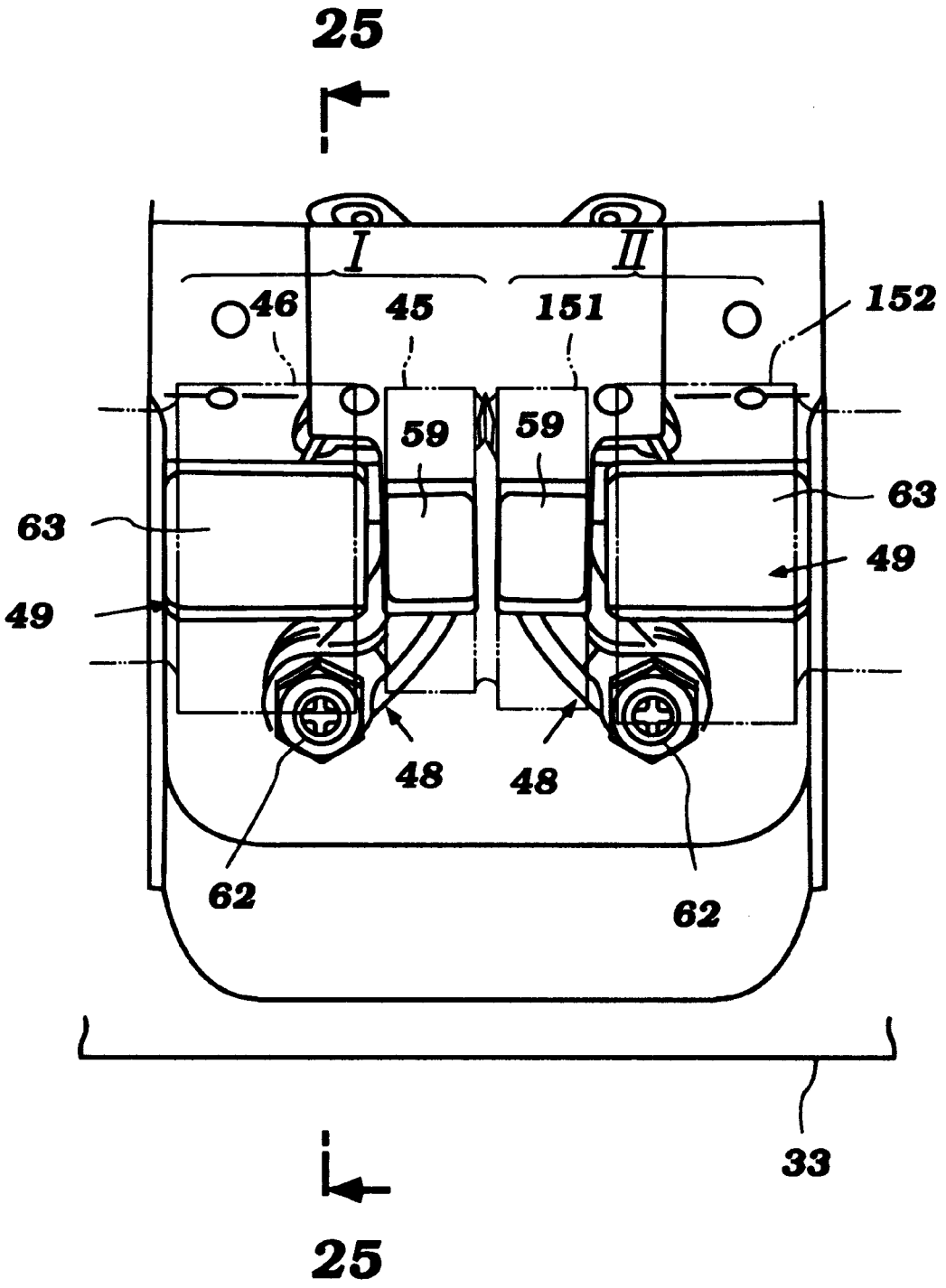
FIG. 24 is a top plan view, in part similar to FIG. 12, but shows an embodiment in accordance with this invention.
Figure 25:
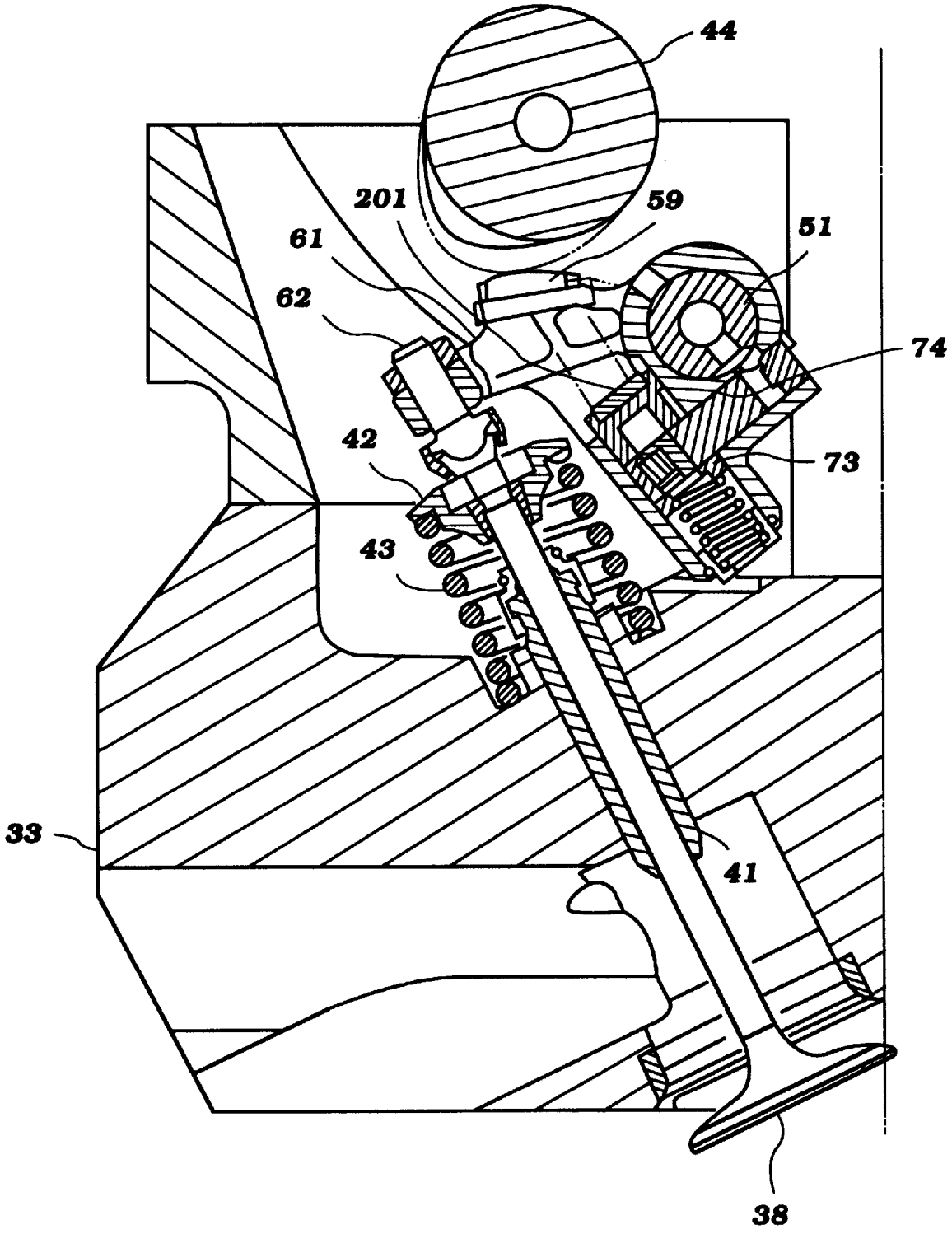
FIG. 25 is an enlarged cross-sectional view taken along the line 25—25 of FIG. 24.

Next is described the added embodiment of this application, that of FIGS. 24 and 25 which avoids these disadvantages. FIGS. 24 and 25 show an embodiment which is generally the same as the embodiment of FIGS. 12–20 but also permits the use of the biasing arrangement as seen in FIGS. 15 and 23.

This embodiment differs from that earlier embodiment only in the way in which the two rocker arms 48 and 49 cooperate with each other so as to avoid the necessity of utilizing the adjusting screws 65. As may be seen in FIG. 24, this permits the bearing area 63 of the second rocker arms to be substantially wider. Also the cam lobes 46 and 152 may be so widened. Thus, wear can be reduced and also the entire cylinder head construction can be made more compact.

In this embodiment, the portion of the rocker arm 63 which previously carried the adjusting screw 65 merely overlie an adjusting pad 201 (FIG. 25) that is received in a complimentary recess formed in the upper portion of the plunger assembly 73 and specifically the member 76 thereof. The height or thickness of this shim 201 can be varied so as to provide the desired clearance and avoid the use of an adjusting screw. In addition, this arrangement provides a larger wear area between the two rocker arms 49 and 48 and thus also reduces wear. In all other regards, this construction is the same as that previously described.

It is also to be understood that this type of adjusting arrangement can be utilized in all of the embodiments of this application and those other embodiments of the parent application that are not carried through herewith.

From the foregoing description, it should be readily apparent to those skilled in the art that the various embodiments disclosed provide a very effective and compact arrangement for achieving variable valve actuation.

What is claimed is:

1. A valve operating mechanism for operating a single poppet valve of an engine through cooperation with the stem thereof, said valve operating mechanism being comprised of a single cam shaft having a pair of adjacent cams, a pair of adjacent pivotally supported rocker arms, each of said rocker arms being operated by a respective one of said said cams, a first of said rocker arms having an operating portion for direct engagement with the valve stem for operating the valve directly, and means for selectively coupling the second of said rocker arms to said first rocker arm comprising a plunger slidably supported within a bore formed in said first rocker arm, a replaceable adjusting shim engaged by actuating means carried by said second rocker arm, said plunger being engaged by said replaceable adjusting shim, and means for coupling said plunger against movement relative to the first rocker arm for effecting simultaneous movement of the rocker arms for effecting actuation of the valve therefrom through said first rocker arm by the cam associated with said second rocker arm.

2. A valve operating mechanism as set forth in claim 1, wherein the first and second cams and first and second rocker arms provide a different lift for the actuated valve.

3. A valve operating mechanism as set forth in claim 2, wherein the lift provided by the second cam and second rocker arm is greater than that provided by the first cam and the first rocker arm.

4. A valve operating mechanism as set forth in claim 1, wherein the means for selectively coupling the second rocker arm to the first rocker arm is hydraulically operated.

5. A valve operating mechanism as set forth in claim 4, wherein both of the rocker arms are journaled on the same rocker arm shaft.

6. A valve operating mechanism as set forth in claim 1, wherein the coupling means comprises a pin slidably supported in the first rocker arm and engageable with a bore formed in the plunger for locking the plunger against sliding movement in the bore.

7. A valve operating mechanism as set forth in claim 1, wherein both of the rocker arms are journaled on the same rocker arm shaft.

8. A valve operating mechanism as set forth in claim 7, wherein the first and second cams and first and second rocker arms provide a different lift for the actuated valve.

9. A valve operating mechanism as set forth in claim 8, wherein the lift provided by the second cam and second rocker arm is greater than that provided by the first cam and the first rocker arm.

10. A valve operating mechanism as set forth in claim 5, the rocker arm shaft is hollow and the hydraulic pressure is transmitted through the rocker arm shaft.

11. A valve operating mechanism as set forth in claim 7, wherein the valve has a spring that is associated with it for maintaining the first rocker arm in engagement with the first cam and further including a separate biasing spring for urging the second rocker arm into engagement with the second cam.

12. A valve operating mechanism as set forth in claim 11, wherein the second spring is engaged with an arm of the second rocker arm that is spaced from its actuating portion and which spring bears against the engine body.

13. A valve operating mechanism as set forth in claim 1, wherein there is provided a second poppet valve for serving the same combustion chamber of the engine and wherein the second poppet valve is adjacent the first mentioned poppet valve.

14. A valve operating mechanism as set forth in claim 13, wherein both poppet valves communicate with the combustion chamber.

15. A valve operating mechanism as set forth in claim 14, wherein the second poppet valve is operated by a third cam through a third rocker arm.

16. A valve operating mechanism as set forth in claim 15, wherein all of the rocker arms are supported on the same rocker arm shaft.

17. A valve operating mechanism as set forth in claim 16, the valves are both intake valves.

18. A valve operating mechanism as set forth in claim 17, wherein the first valve is operated with a low lift by the first cam and the first rocker arm and a higher lift by the second cam and the second rocker arm acting through the first rocker arm and wherein the third cam and the third rocker arm provide a lift for the second valve that is higher than that of the first cam and the first rocker arm on the first valve.

19. A valve operating mechanism as set forth in claim 18, wherein separate intake passages serve the intake valves and further including a control valve in the intake passage serving the second valve controlled in response to engine running conditions and opened under only high speed, high load conditions.

20. A valve operating mechanism as set forth in claim 13, wherein the second valve is operated by first and second rocker arms each cooperating with a respective cam lobe to provide a different lift and further including means for selectively coupling the first and second rocker arms associated with the second valve with each other for varying the lift of the second valve.

21. A valve operating mechanism as set forth in claim 20, wherein the first rocker arms for the two valves are disposed adjacent each other on the rocker arm shaft.

22. A valve operating mechanism as set forth in claim 21, wherein the lift provided by the first cam and first rocker arm of one of the valves is different from that provided by the first cam and first rocker arm of the other valve.

23. A valve operating mechanism as set forth in claim 20, wherein the second rocker arms are disposed adjacent each other on the same rocker arm shaft.

24. A valve operating mechanism as set forth in claim 23, wherein the lift provided by the first cam and first rocker arm of one of the valves is different from that provided by the first cam and first rocker arm of the other valve.

* * * * *